US006493893B1

(12) United States Patent
Ackeret

(10) Patent No.: US 6,493,893 B1
(45) Date of Patent: Dec. 17, 2002

(54) MULTI-PURPOSE HAND-HELD DEVICE

(75) Inventor: Peter Ackeret, Kusnacht (CH)

(73) Assignee: Ctech AG, Landquart (CH)

( * ) Notice: Subject to any disclaimer, the term of this patent is extended or adjusted under 35 U.S.C. 154(b) by 0 days.

(21) Appl. No.: 09/355,252

(22) PCT Filed: Jan. 28, 1998

(86) PCT No.: PCT/EP98/00446

§ 371 (c)(1),
(2), (4) Date: Mar. 14, 2000

(87) PCT Pub. No.: WO98/32570

PCT Pub. Date: Jul. 30, 1998

(30) Foreign Application Priority Data

Jan. 28, 1997 (DE) ..... 197 02 955
Oct. 16, 1997 (DE) ..... 197 45 799

(51) Int. Cl.[7] ..... B26B 11/00
(52) U.S. Cl. ..... 7/160; 7/168
(58) Field of Search ..... 7/160, 167, 168; 227/63, 76; 83/618, 686, 684

(56) References Cited

U.S. PATENT DOCUMENTS

| | | | | |
|---|---|---|---|---|
| 2,264,322 | A | 12/1941 | Maynard | 1/3 |
| 2,486,500 | A | 11/1949 | Shocket | 1/49 |
| 2,726,393 | A | 12/1955 | Vogel | 1/3.05 |
| 3,640,443 | A | 2/1972 | Itagaki | 227/120 |
| 3,907,190 | A | 9/1975 | Mitsuhashi | 227/127 |
| 3,951,325 | A | 4/1976 | Mitsuhashi | 227/76 |
| 4,002,281 | A | 1/1977 | Hsu | 227/63 |
| 4,040,556 | A | 8/1977 | Dahle | |
| 4,114,793 | A | 9/1978 | Hsu | 227/63 |
| 4,240,572 | A | 12/1980 | Mitsuhashi | 227/76 |
| 4,288,018 | A | 9/1981 | Taniguchi | 227/76 |
| 4,491,261 | A | 1/1985 | Mitsuhashi | 227/76 |
| 4,640,451 | A | 2/1987 | Steiner et al. | 227/76 |
| 4,727,610 | A | 3/1988 | Lin | 7/160 |
| 4,729,170 | A | 3/1988 | Hartmeister | 30/363 |
| 4,779,785 | A | 10/1988 | Amagaya | 227/76 |
| 4,783,867 | A | 11/1988 | Tsao | 7/160 |
| 4,794,692 | A | 1/1989 | Wang | 30/123 |
| D302,102 | S | 7/1989 | Amagaya | |
| 5,027,994 | A | 7/1991 | Lee | 227/120 |
| 5,114,257 | A | 5/1992 | Hsu | 401/195 |
| 5,184,765 | A | 2/1993 | Orozco | 227/27 |
| 5,584,124 | A | 12/1996 | Marthaler et al. | 30/363 |
| 5,655,697 | A | 8/1997 | Yeh | 227/27 |
| 5,960,498 | A | 10/1999 | Nabors et al. | |
| 6,038,723 | A | 3/2000 | Nabors et al. | |
| 6,105,189 | A | 8/2000 | Nabors et al. | |

FOREIGN PATENT DOCUMENTS

| | | |
|---|---|---|
| DE | 190350-3458 | 6/1958 |
| DE | 26 25 749 A1 | 12/1977 |

(List continued on next page.)

OTHER PUBLICATIONS

Brochure, "Wenger. The Genuine Swiss Army Knife", 27 pages.
Brochure, "Wenger. The Genuine Swiss Army Knife™", 16 pages.
PCT International Search Report for PCT/EP98/00446, 3 pages (Jun. 29, 1998).

*Primary Examiner*—D. S. Meislin
(74) *Attorney, Agent, or Firm*—Brinks Hofer Gilson & Lione

(57) ABSTRACT

The preferred embodiments described herein relate to a multi-purpose hand-held device. Some of the preferred embodiments describe a multipurpose hand-held implement comprising first and second members connected together to move between a first position, in which they form together an elongated body, and a second position. In one preferred embodiment, a multi-purpose hand-held device is described comprising a stapler and/or punch and other fold-out utensils, wherein a module containing the utensils is preferably incorporated into the stapler-punch component assembly. Other preferred embodiments are described herein.

29 Claims, 24 Drawing Sheets

FOREIGN PATENT DOCUMENTS

Figure 1:
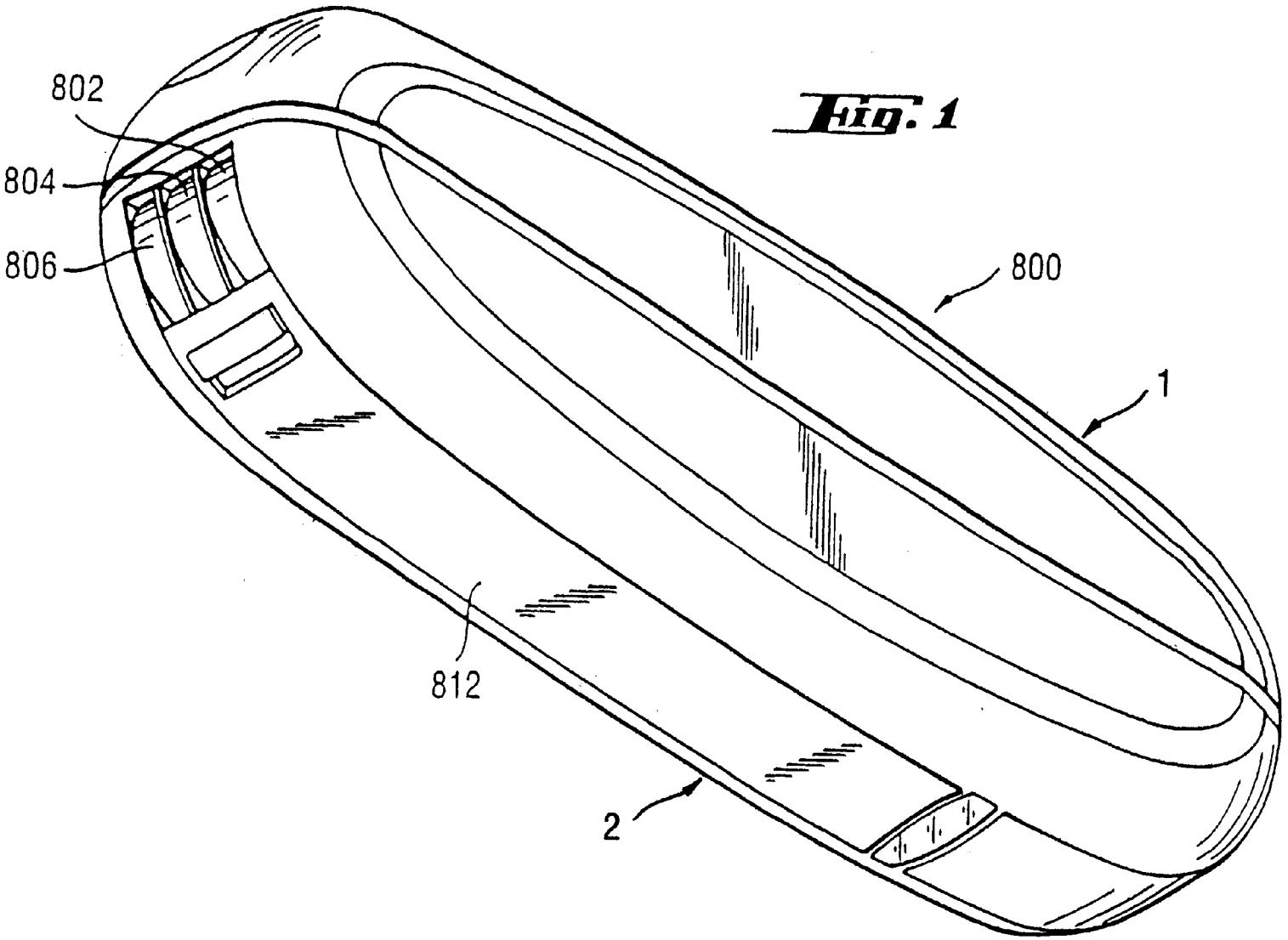

| | | | |
|---|---|---|---|
| DE | 3538596 | | 5/1987 |
| DE | 4021645 | A1 | 2/1991 |
| DE | 41 10 688 | A1 | 9/1991 |
| DE | 195 27 859 | A1 | 1/1997 |
| EP | 0 306 678 | A2 | 3/1989 |
| EP | 0 783 938 | A2 | 7/1997 |
| GB | 2 186 227 | A | 8/1987 |
| GB | 2196896 | A | 4/1988 |
| JP | 41-22884 | | 11/1941 |
| JP | 53-71379 | | 6/1978 |
| JP | 53-71380 | | 6/1978 |
| JP | 2-19484 | | 2/1990 |
| JP | 08112781 | A | 5/1996 |
| WO | WO 84/01739 | | 5/1984 |
| WO | WO 86/01449 | | 3/1986 |
| WO | WO 94/17963 | | 8/1994 |
| WO | WO 95/1113 | | 4/1995 |
| WO | WO 97/04924 | | 7/1996 |

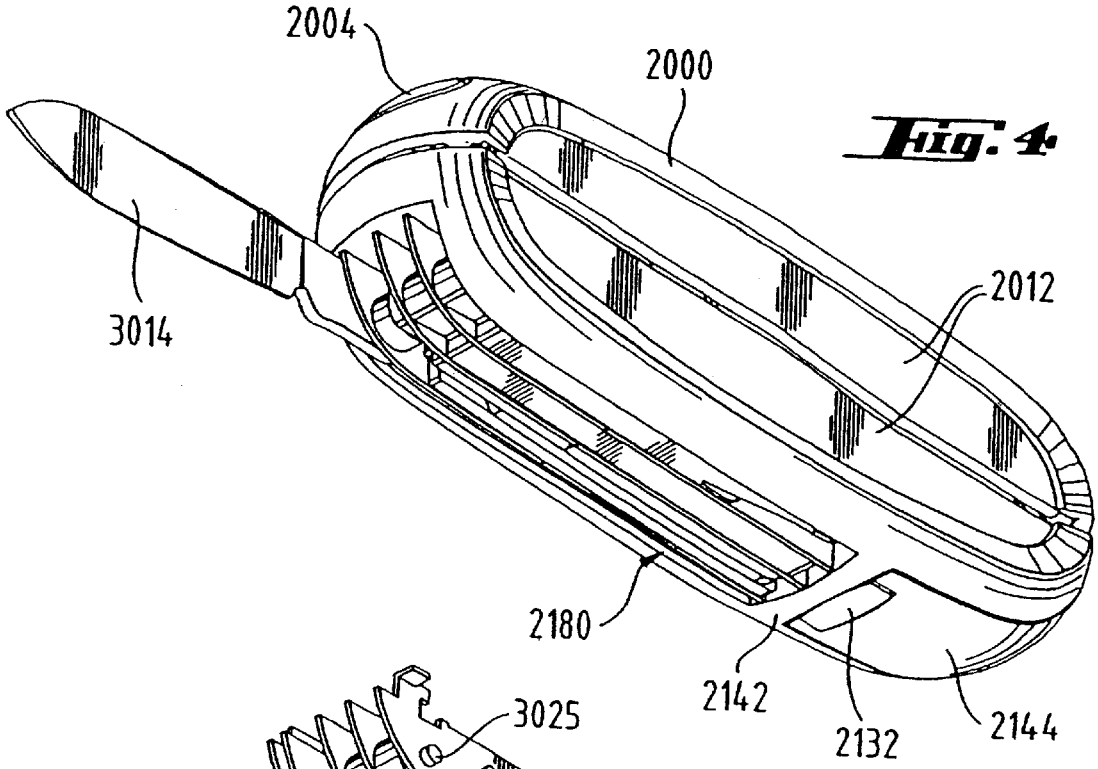
Fig. 4
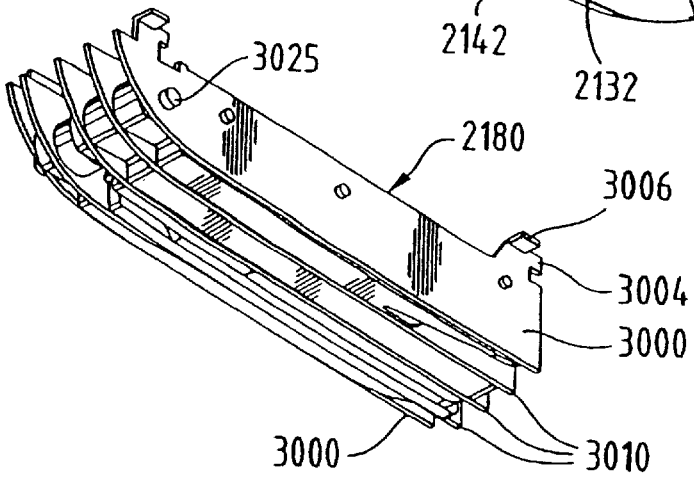
Fig. 5
Fig. 6
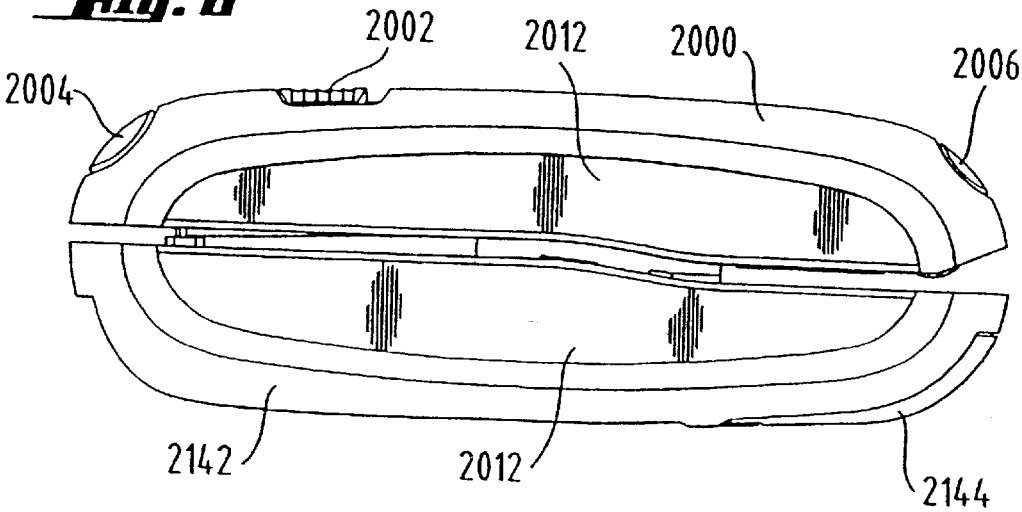

2002
2006
2000
2003
2012
2004
2008
2010
2016
2014
2022
2172
2174
2040
2120
2048
2024
2036
2050
2042
2030
2034
2020
2038
2044
2032
2026
2052
2046
2170
2118
2116
2112
2125
2018
2028
2114
2122
2060
2126
2140
2058
2054
2056
2074
2072
2068
2132
2066
2064
2062
3004
2180
3002
2142
2144

Fig. 12 (A-A)

Fig. 13 (B-B)

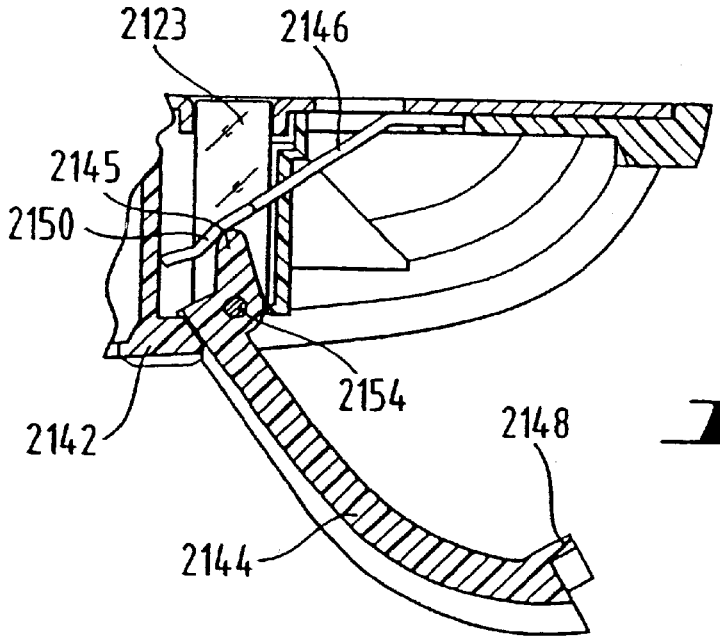
Fig. 16
Fig. 17
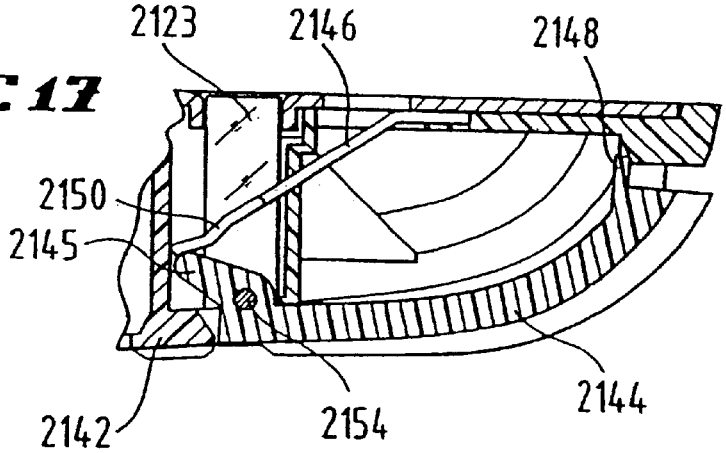
Fig. 18
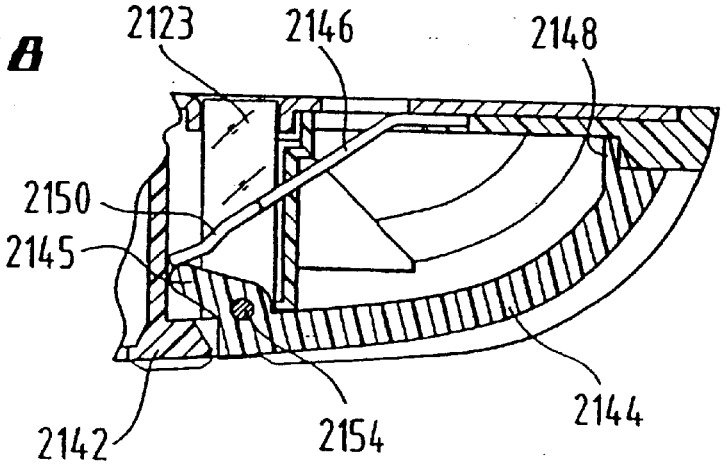

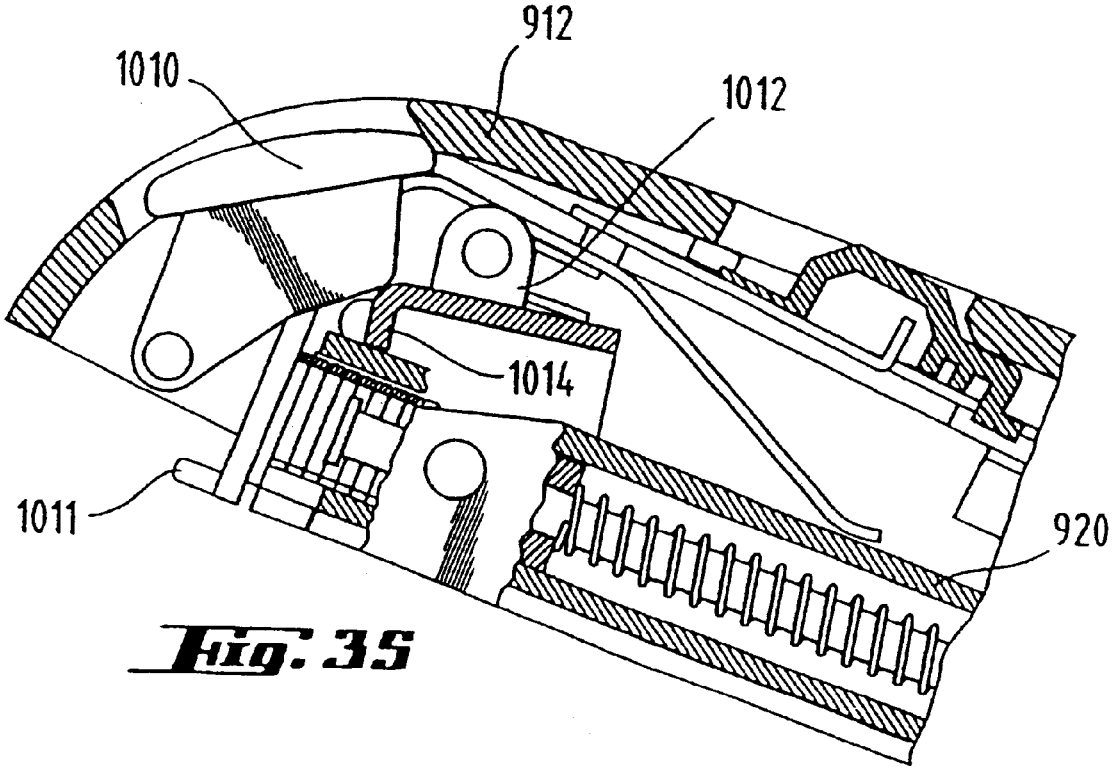
Fig. 35
Fig. 36
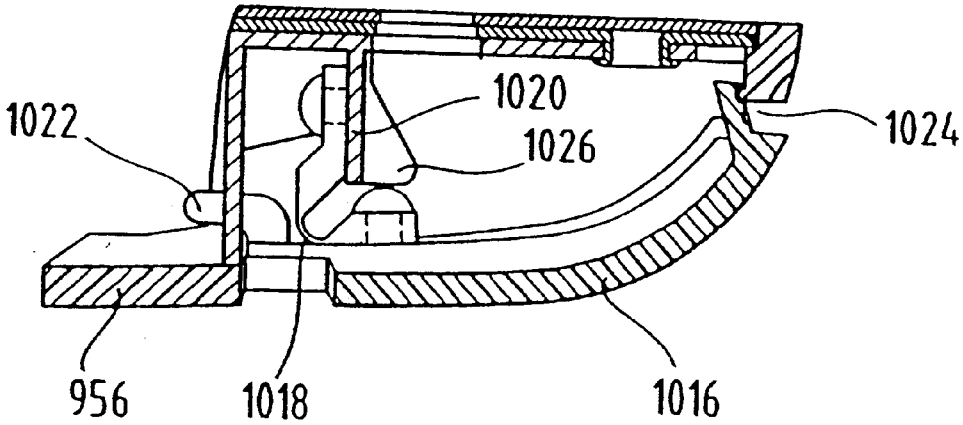

Fig. 37
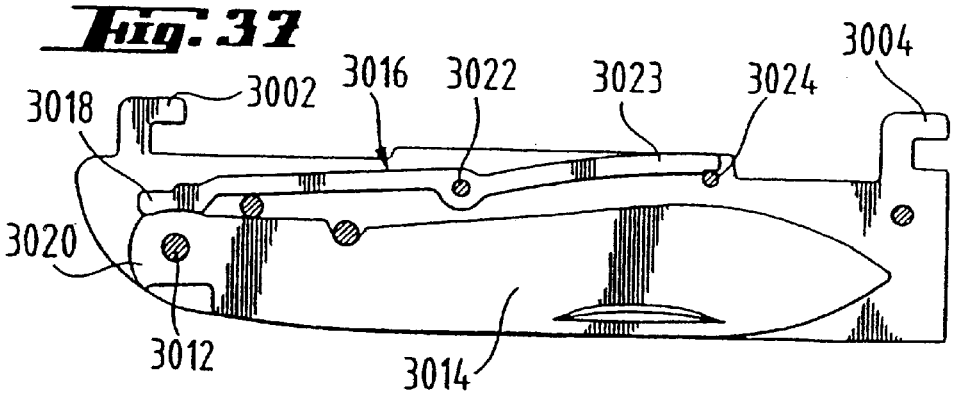
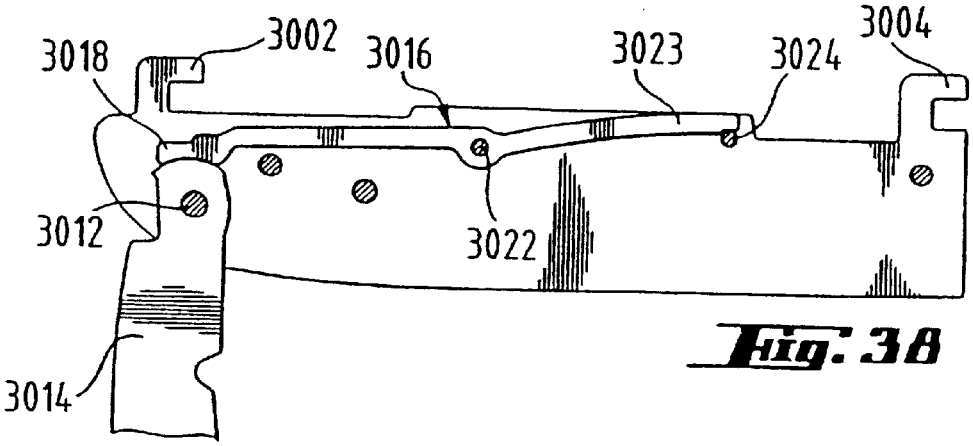
Fig. 38
Fig. 39
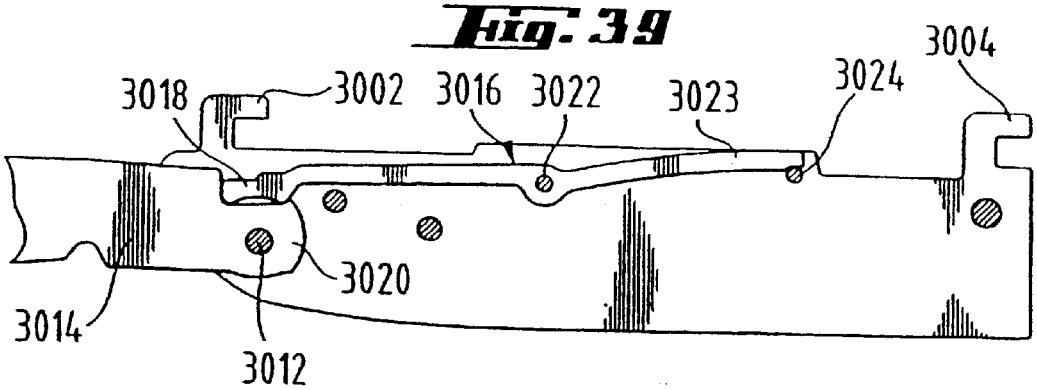
Fig. 40
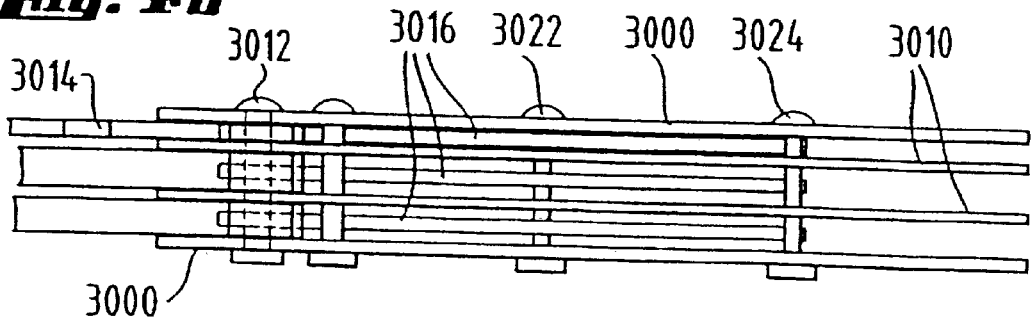

MULTI-PURPOSE HAND-HELD DEVICE

The invention relates to a multipurpose hand-held implement, in particular for office work, which in a stored position forms an elongate, essentially closed parallelepipedic body which is delimited by front surfaces, top surfaces and lateral surfaces and has functional elements of a stapler and/or a hole puncher, and is provided with at least one insertion slot, which runs inward from one of the front surfaces, for material which is to be stapled or punched.

Such a hand-held implement forms the subject-matter of our earlier European Patent Application 96927627.8, which was not published before the priority date. The implement described in that document comprises a first member and a second member which are connected to one another in an articulated manner and the relative movement of which actuates a stapler and a hole puncher. Furthermore, various utensils, such as knives, cutters, scissors and so on, which are preferably accommodated in a slidingly movable manner in channels of the implement and are pushed out of these channels in order to be used, are provided on or in the implement. For stability reasons, these sliding guides have to be of relatively solid design, which makes the implement relatively large and heavy.

The object of the invention is to provide an implement of the type outlined in the introduction which, while being highly stable, is relatively lightweight and small.

The invention additionally relates to a stapler mechanism which is suitable for use in the implement according to the invention.

Finally, the invention relates to a hole puncher mechanism which is suitable for use in the implement according to the invention. The invention also relates to an implement of the construction mentioned in the introduction in the case of which a sliding utensil is provided in addition to swing-out utensils.

Exemplary embodiments of the subject matter of the invention are explained in more detail hereinbelow with reference to the attached drawings.

Figure 2:
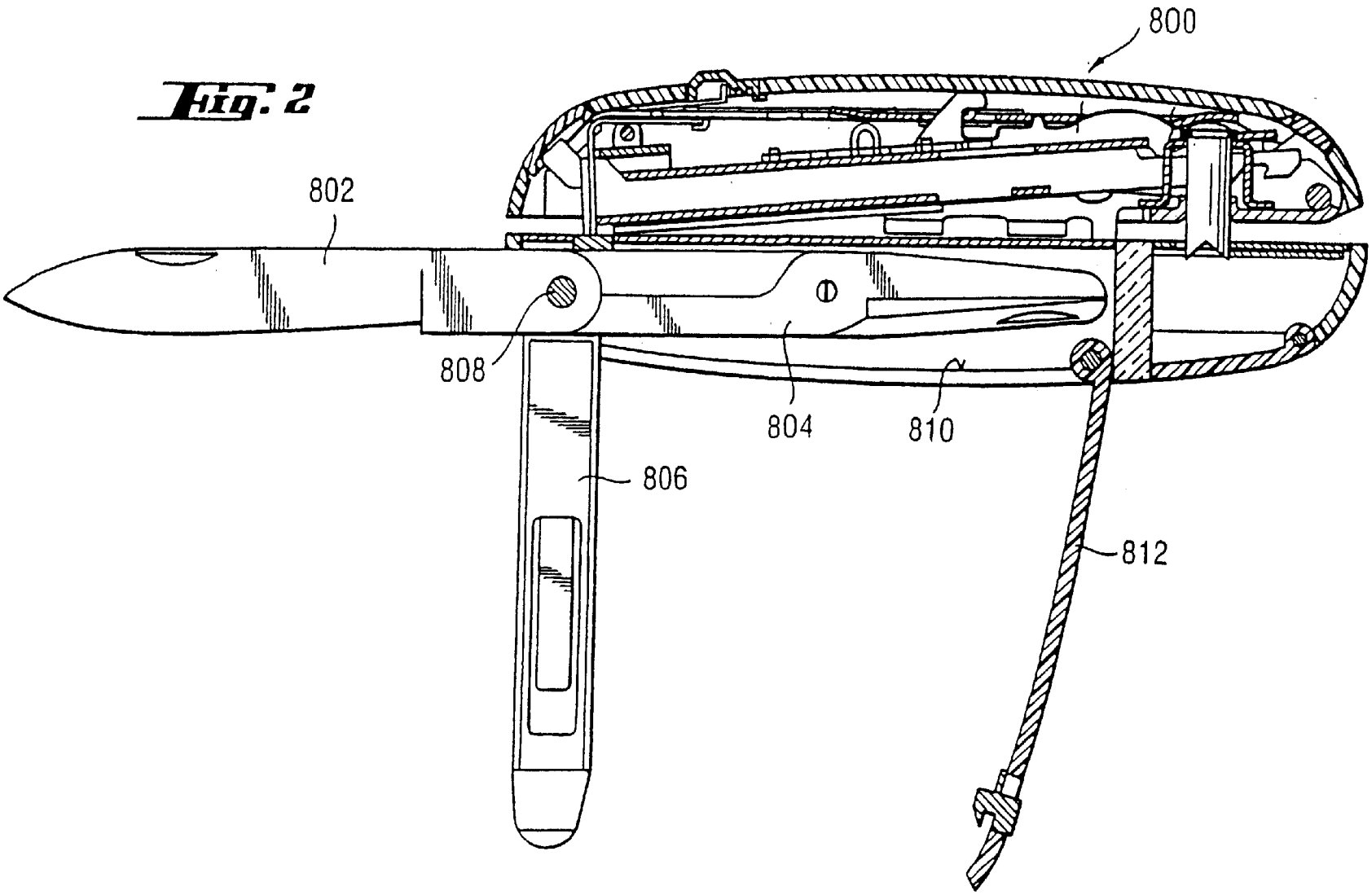
Figure 3:
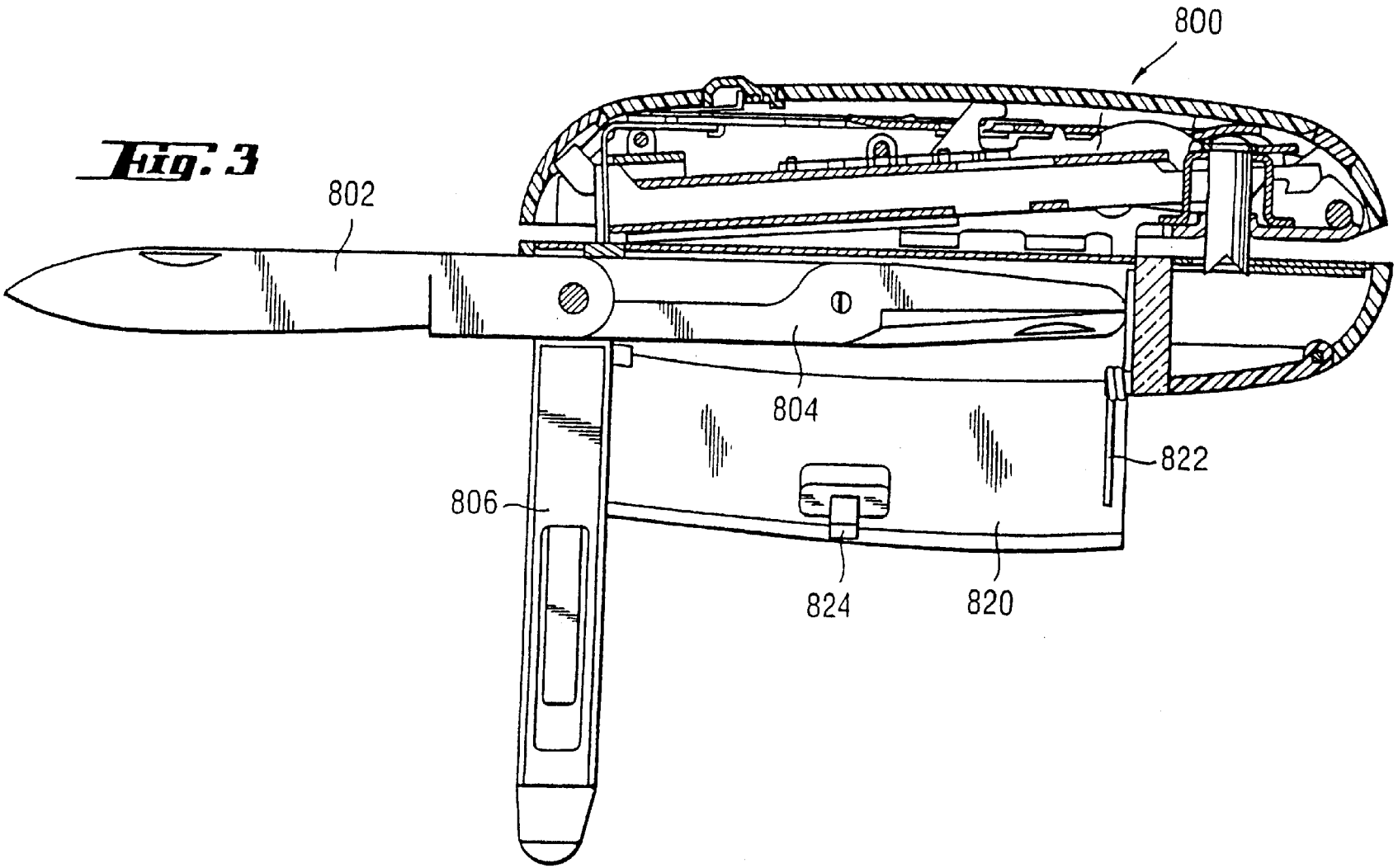
Figure 7:
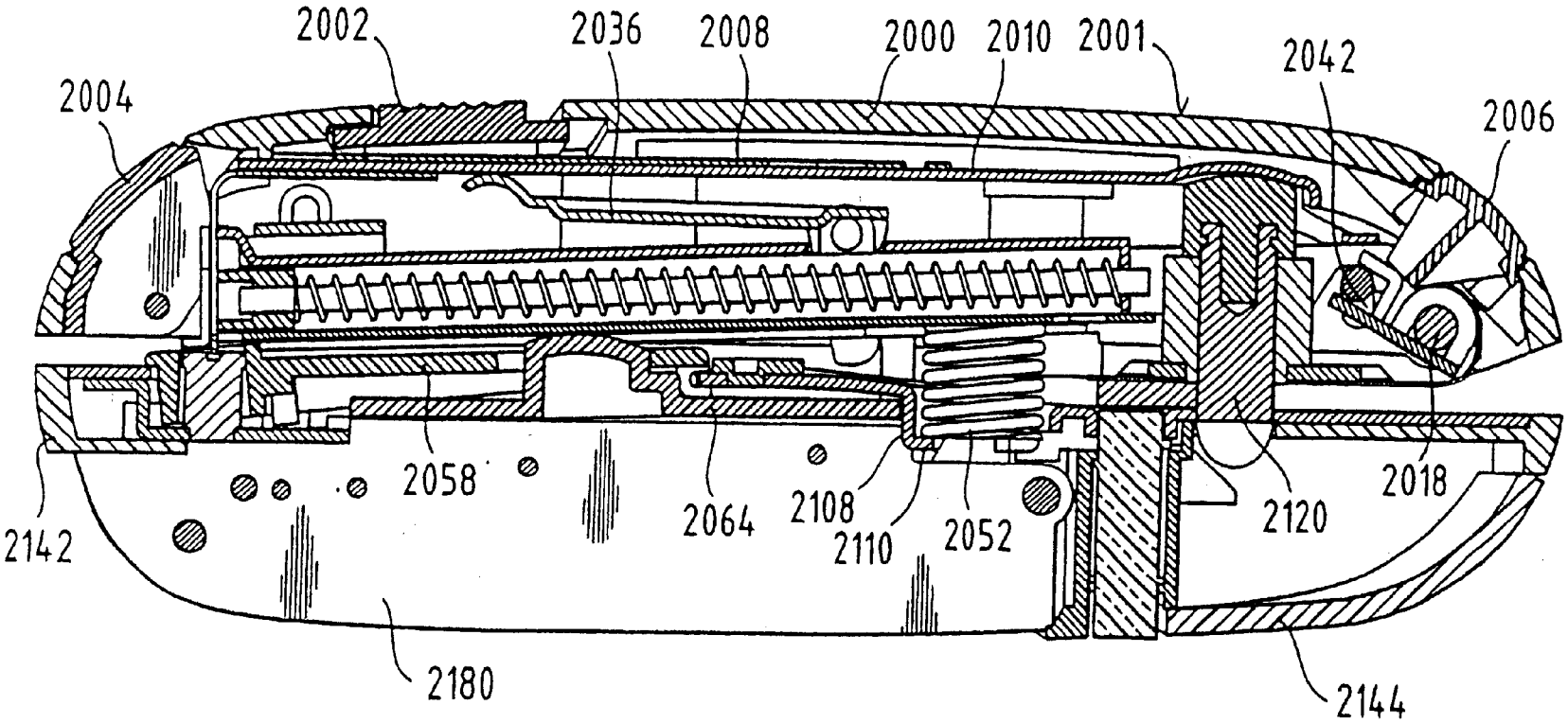
Figure 8:
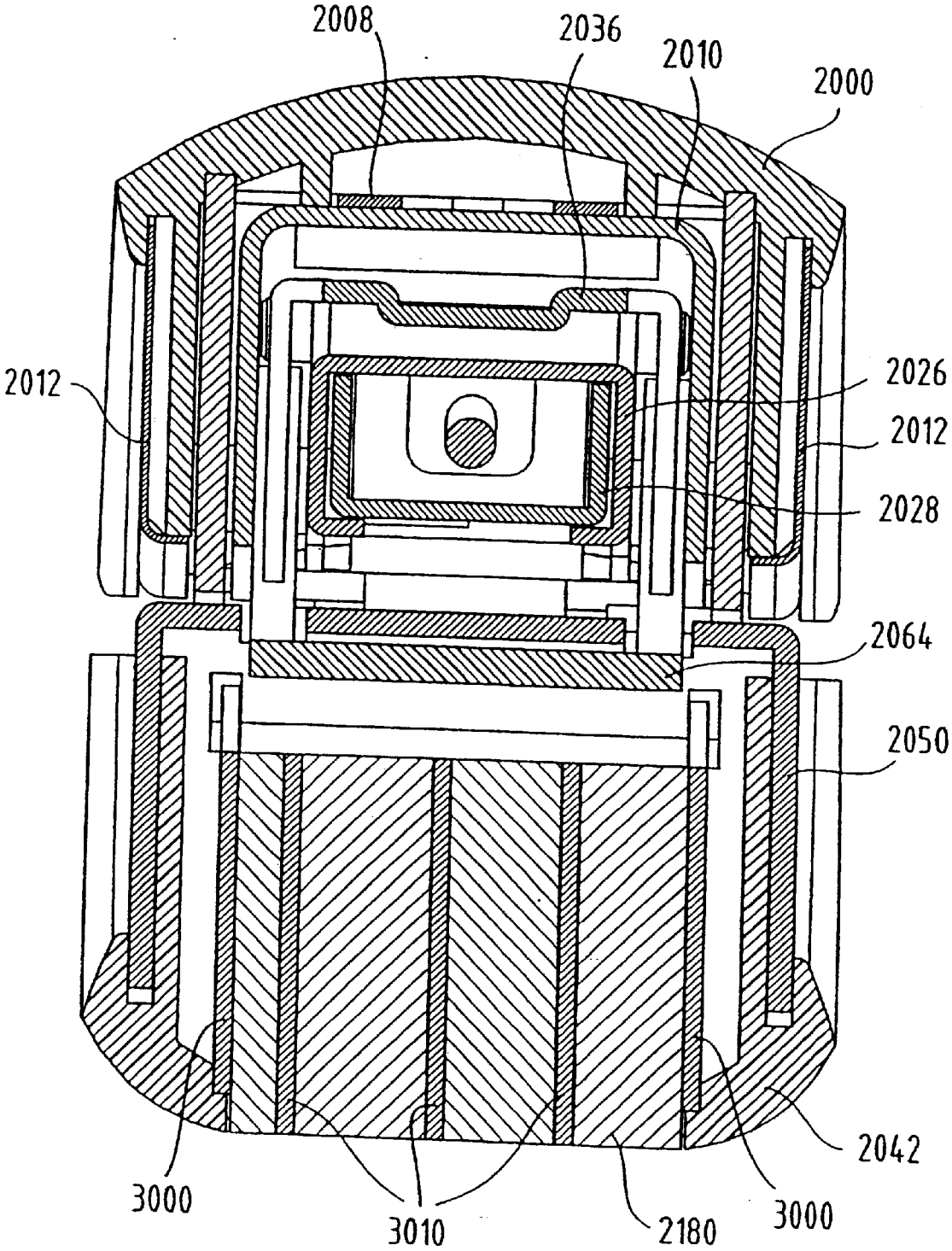
Figure 9:
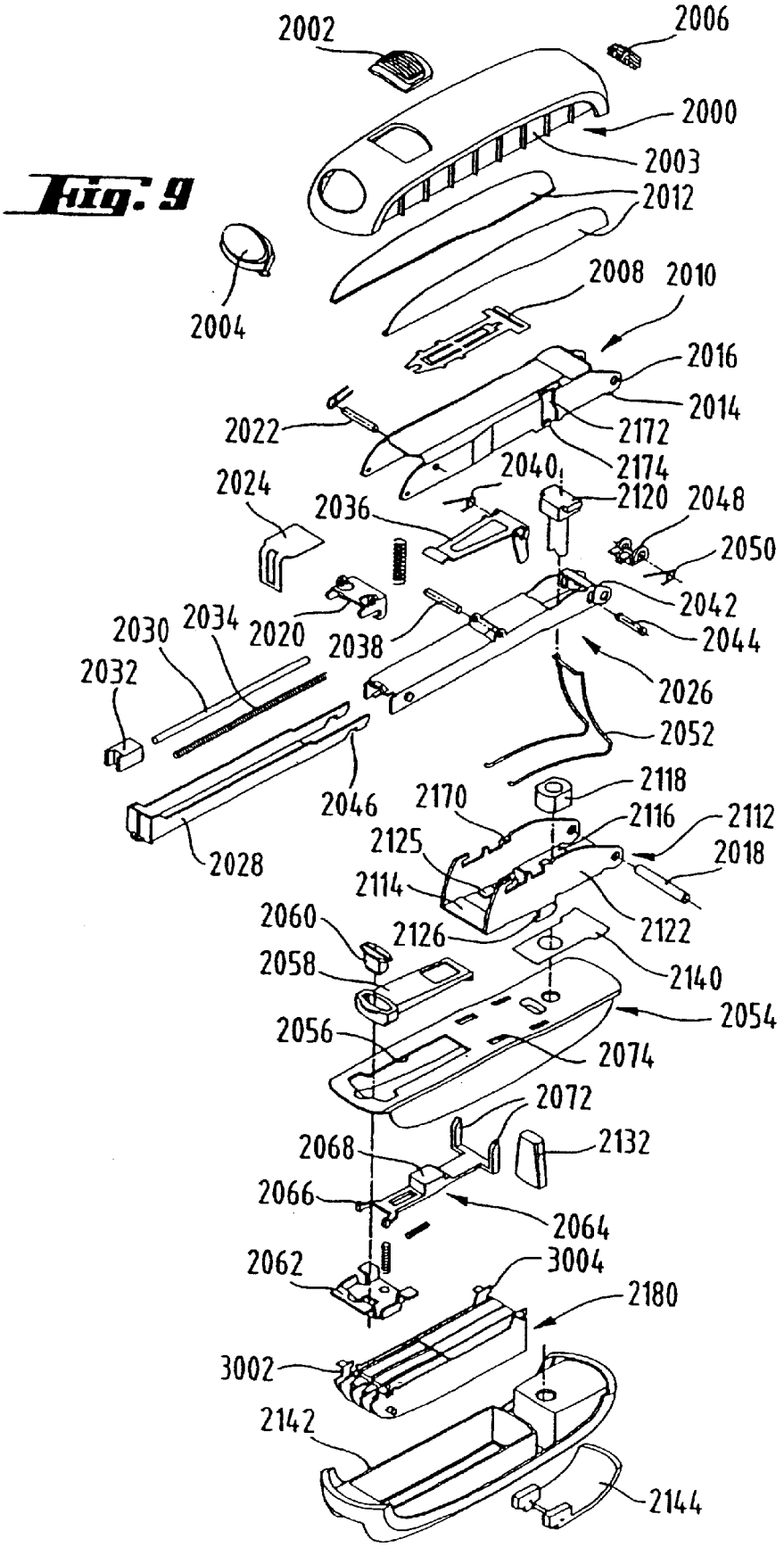
Figure 10:
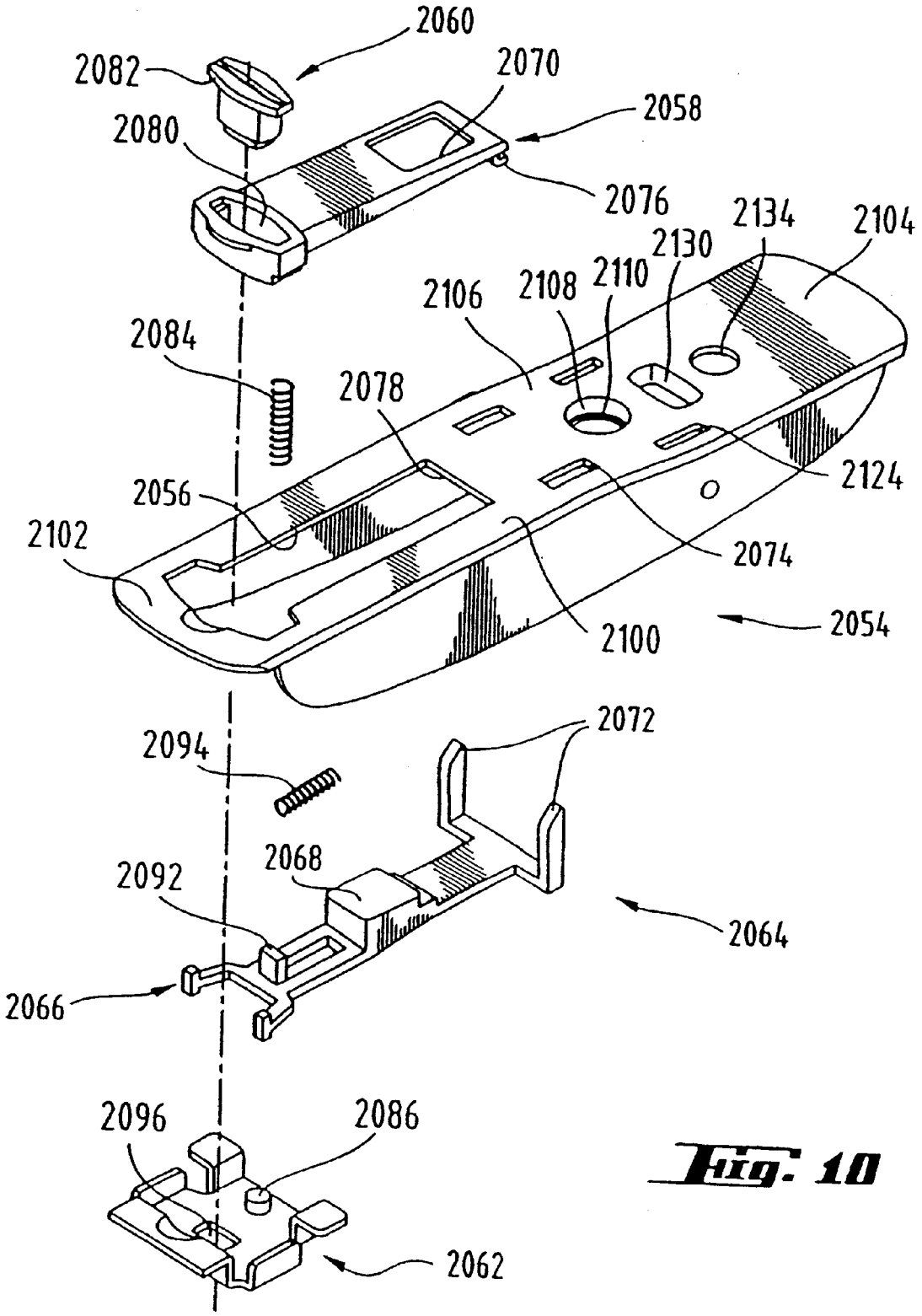
Figure 11:
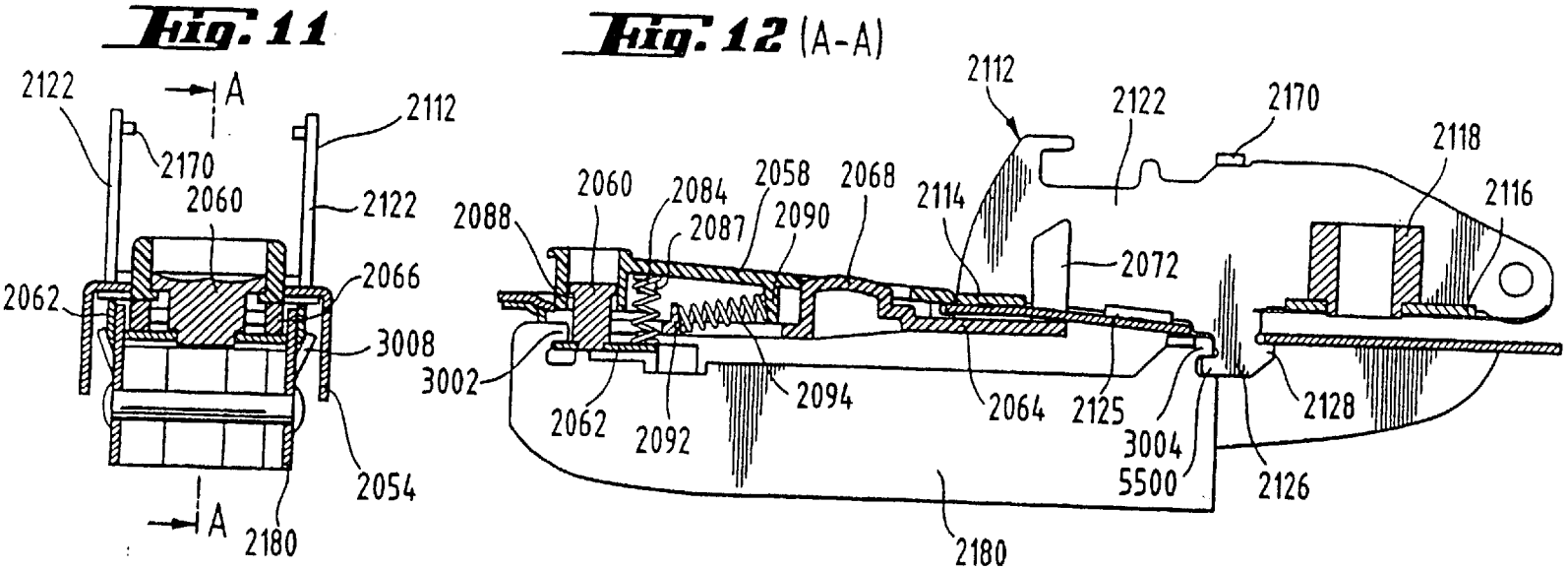
Figure 14:
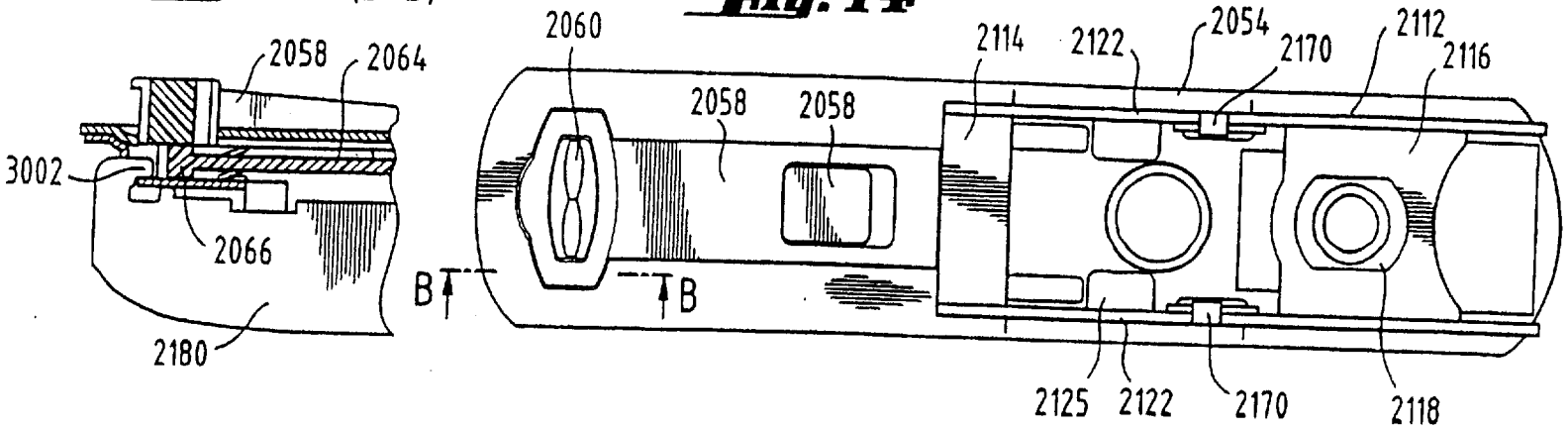
Figure 15:
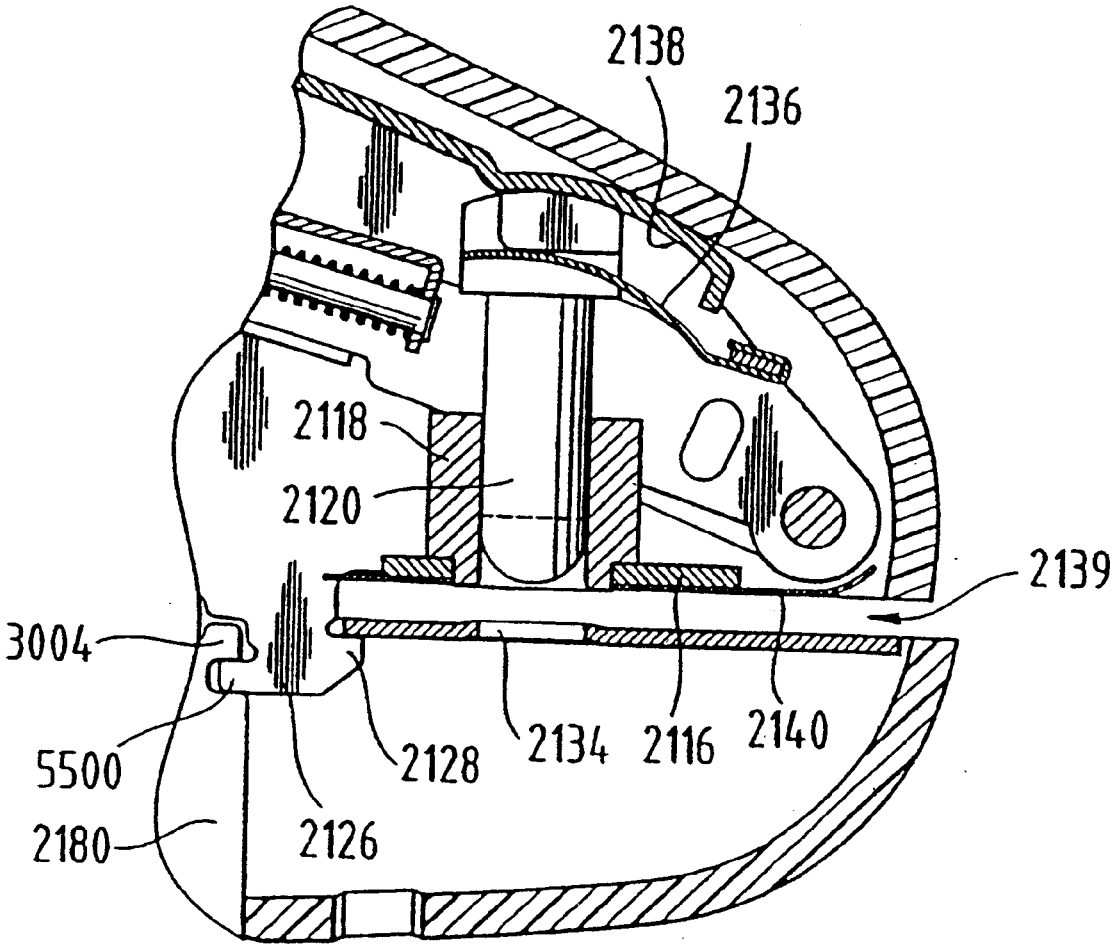
Figure 19:
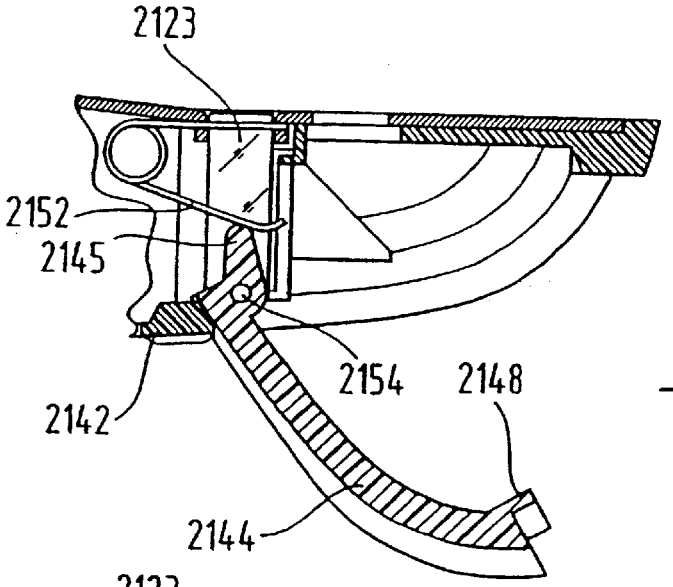
Figure 20:
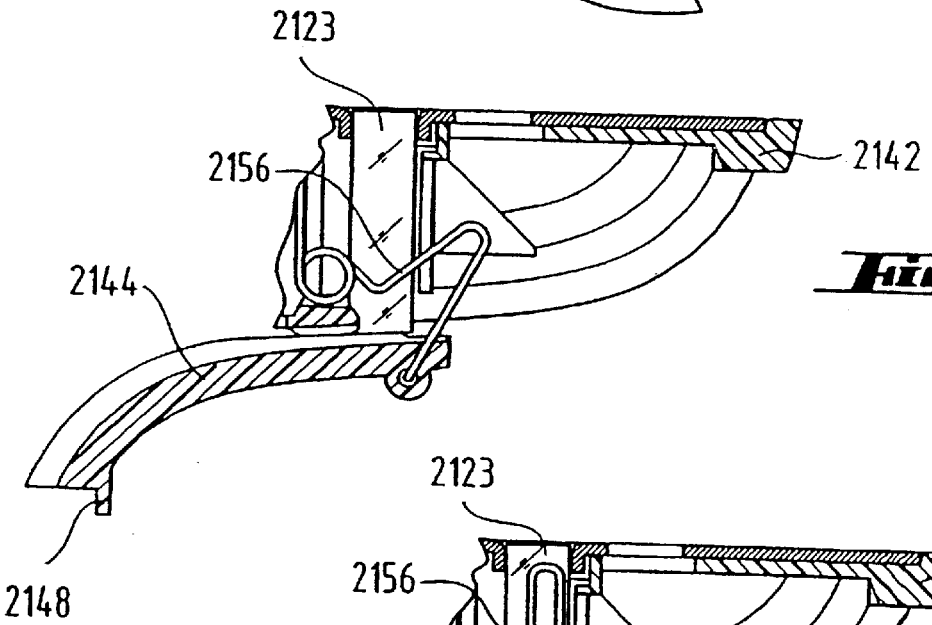
Figure 21:
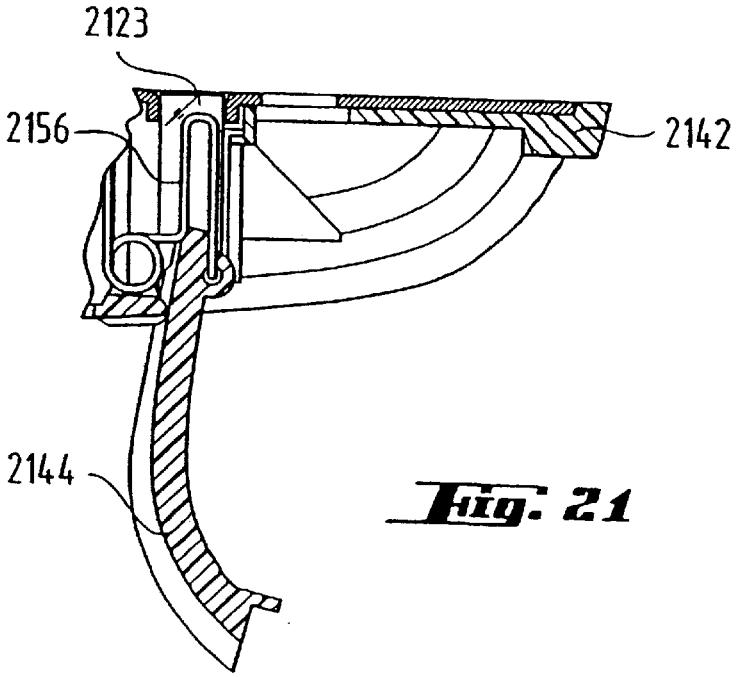

FIG. 1 shows, in perspective, a first embodiment of an implement according to the invention, FIG. 2 is a longitudinally sectioned illustration of the implement according to FIG. 1, FIG. 3 shows, similarly to FIG. 2, a modification of the implement, FIG. 4 shows, in perspective, a second embodiment of an implement according to the invention, FIG. 5 shows a utensil module of the implement according to FIG. 4, FIG. 6 is a side view of the implement according to FIG. 4, FIG. 7 is a longitudinally sectioned illustration of the implement according to FIG. 4, FIG. 8 is a cross-sectional illustration of the implement according to FIG. 4, FIG. 9 shows an exploded illustration of the implement according to FIG. 4, FIG. 10 shows details of the stapler mechanism in an exploded illustration, FIGS. 11 to 13 show sectional views of the skeleton of the lower part of the implement, with the module attachment means and parts of the stapler mechanism, FIG. 14 shows a plan view of the bottom part of the implement according to FIGS. 11 to 13, FIG. 15 shows. in longitudinal section, details of the hole puncher mechanism, FIGS. 16 to 18 show, partially in section, a chad container in various functional positions, FIGS. 19 to 21 show, similarly, a modified chad container.

Figure 24:
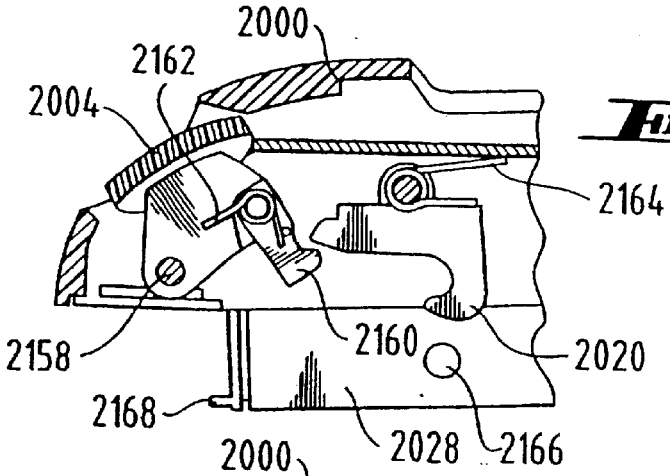
Figure 25:
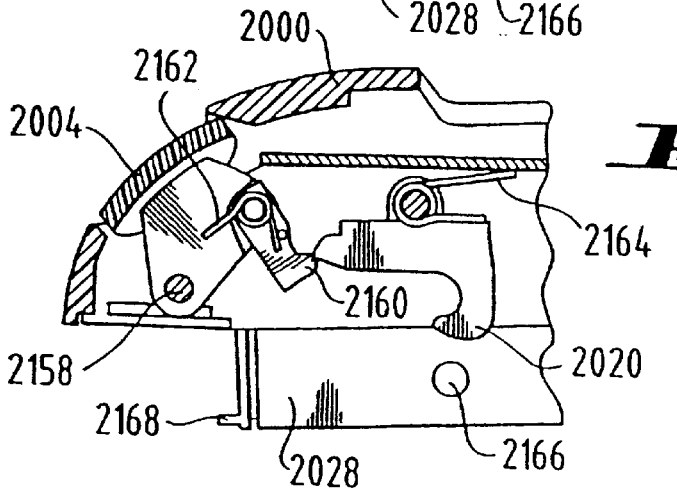
Figure 26:
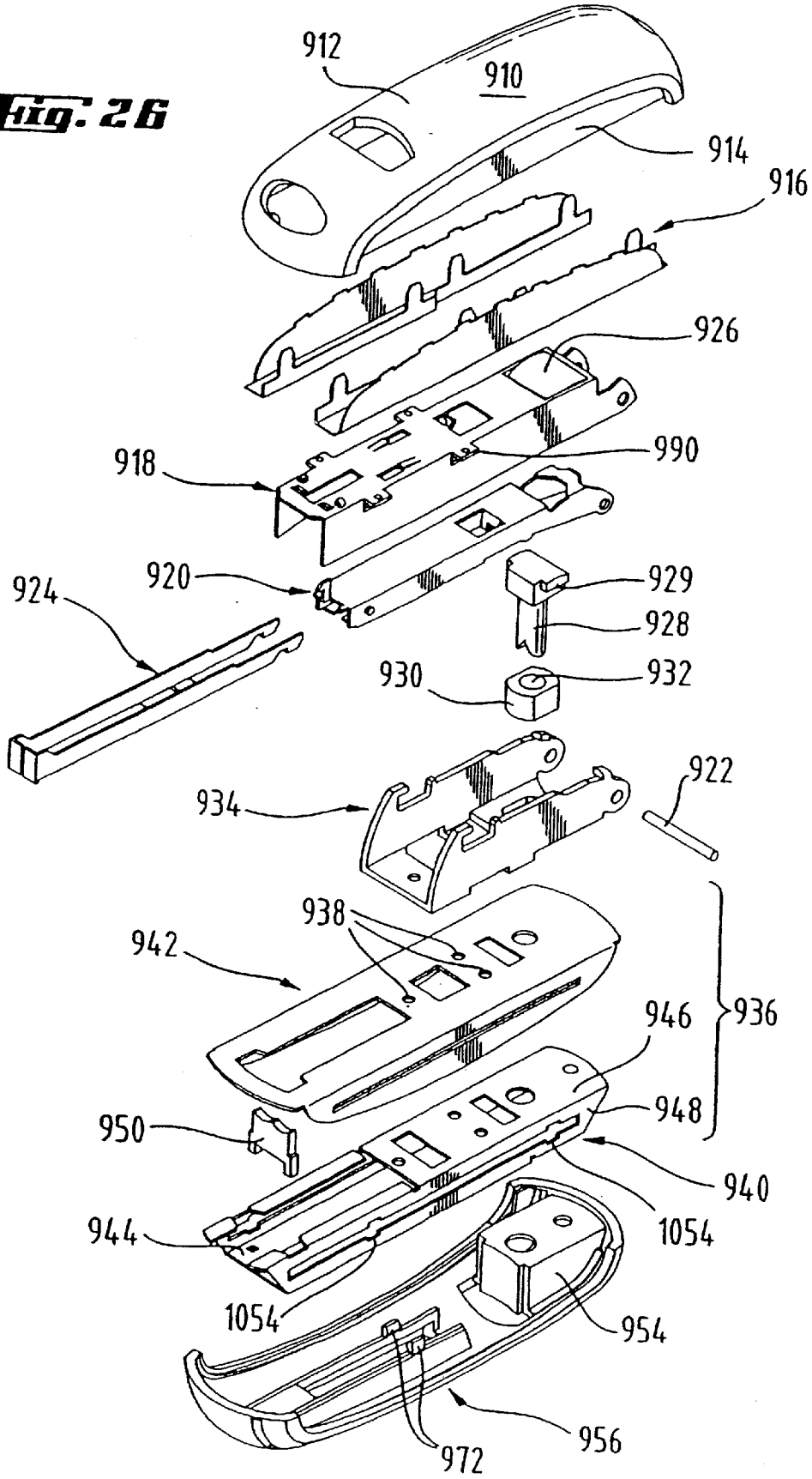
Figure 27:
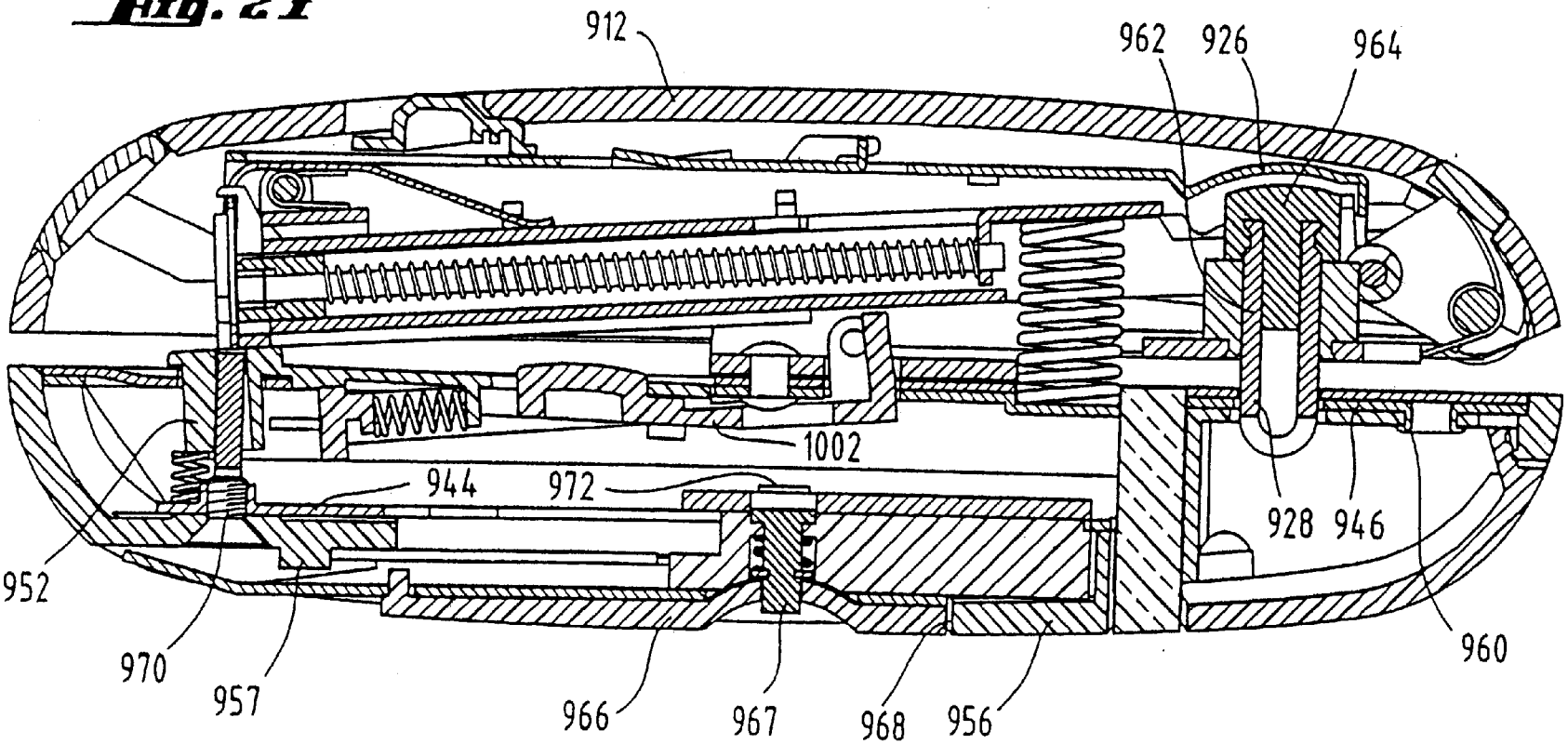
Figure 28:
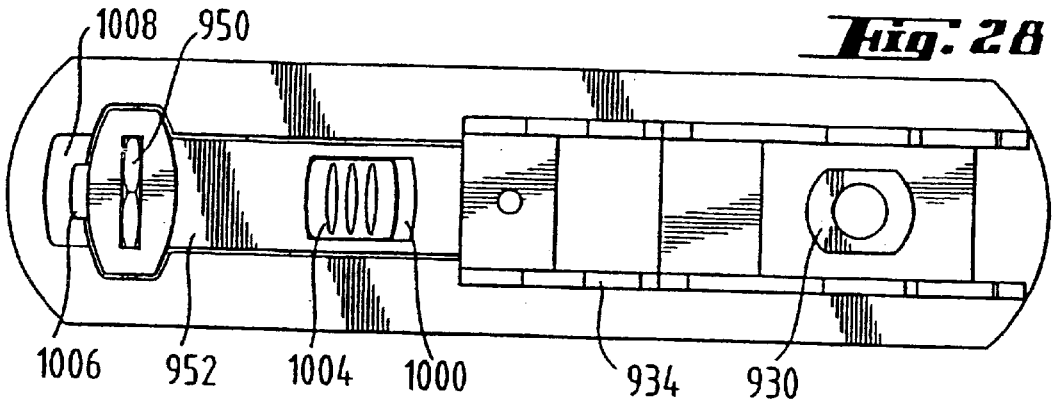
Figure 29:
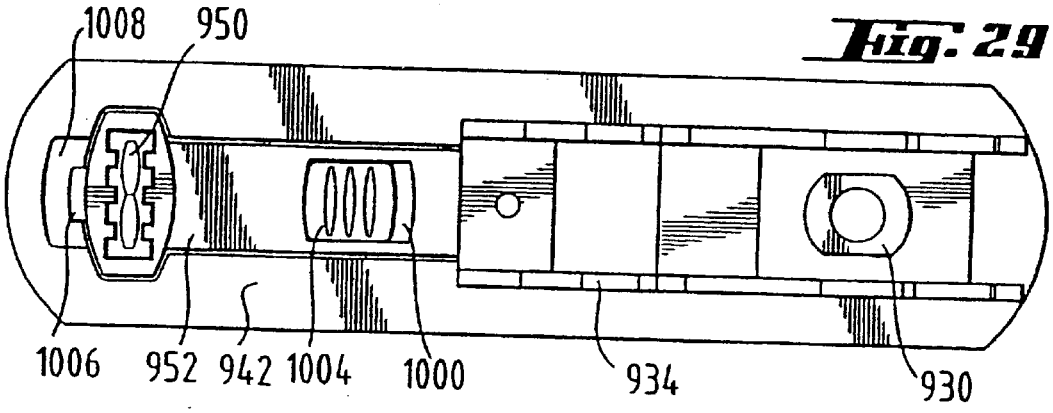
Figure 30:
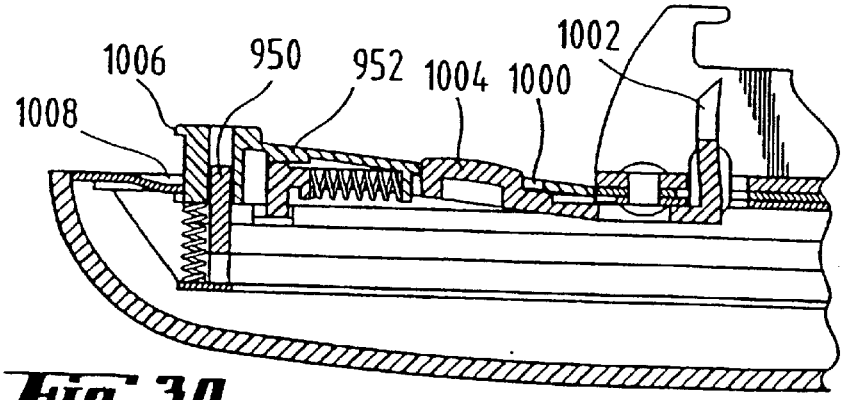
Figure 31:
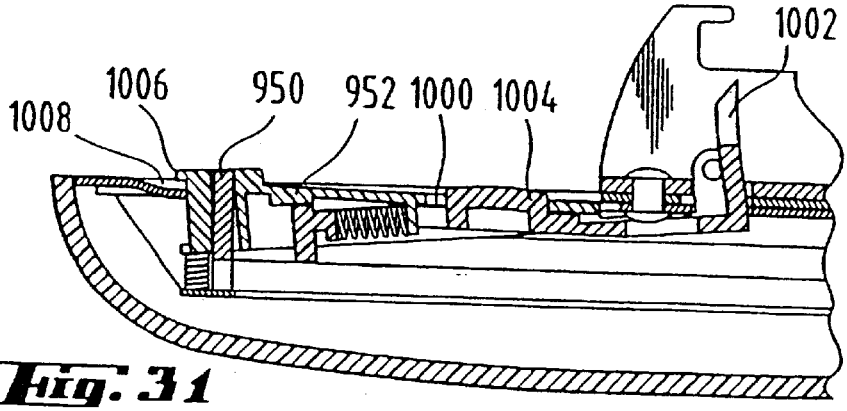
Figure 32:
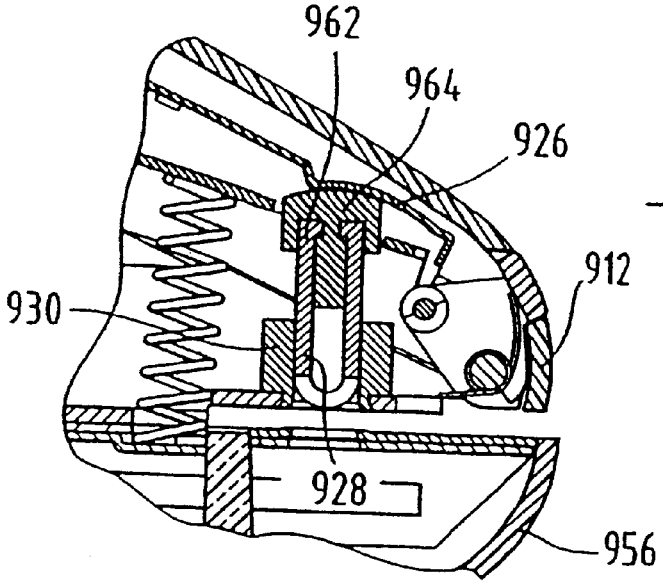
Figure 33:
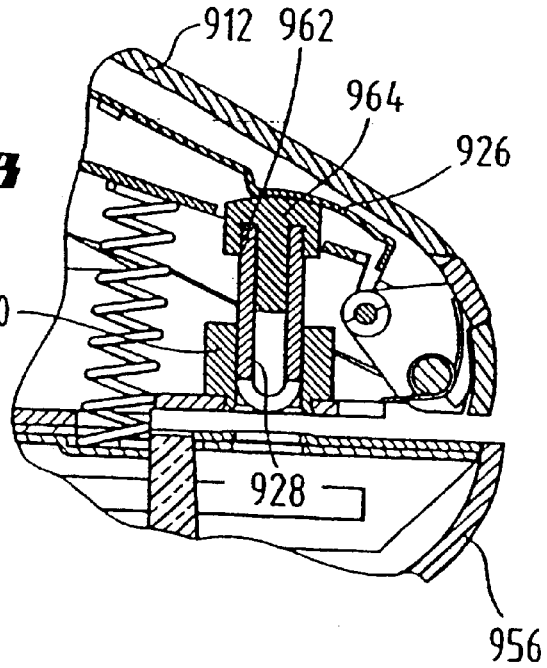
Figure 34:
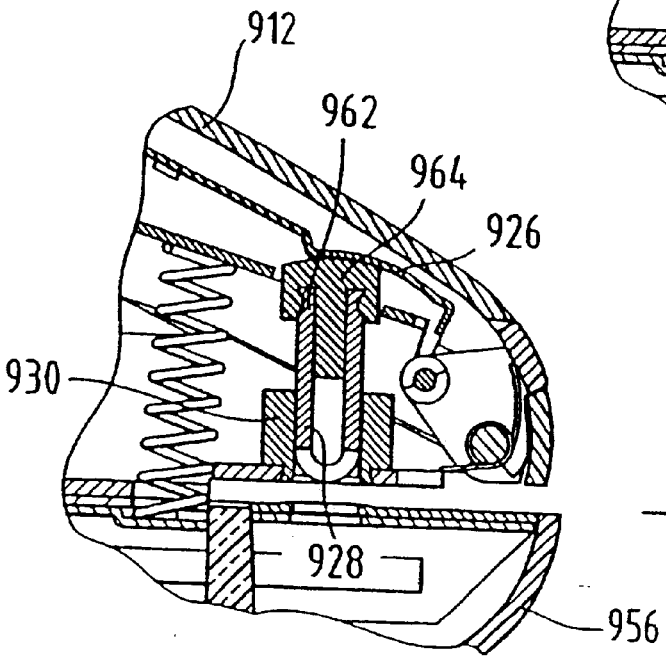
Figure 46:
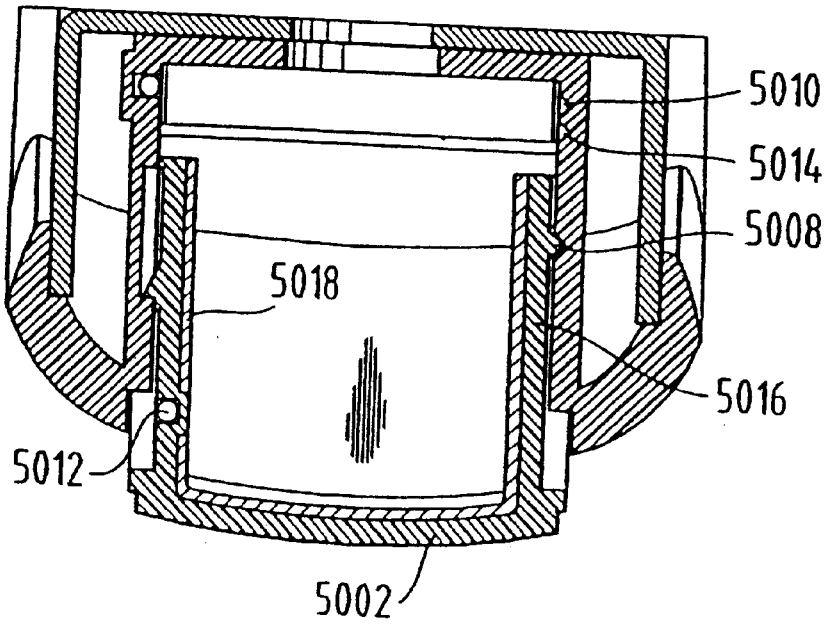
Figure 47:
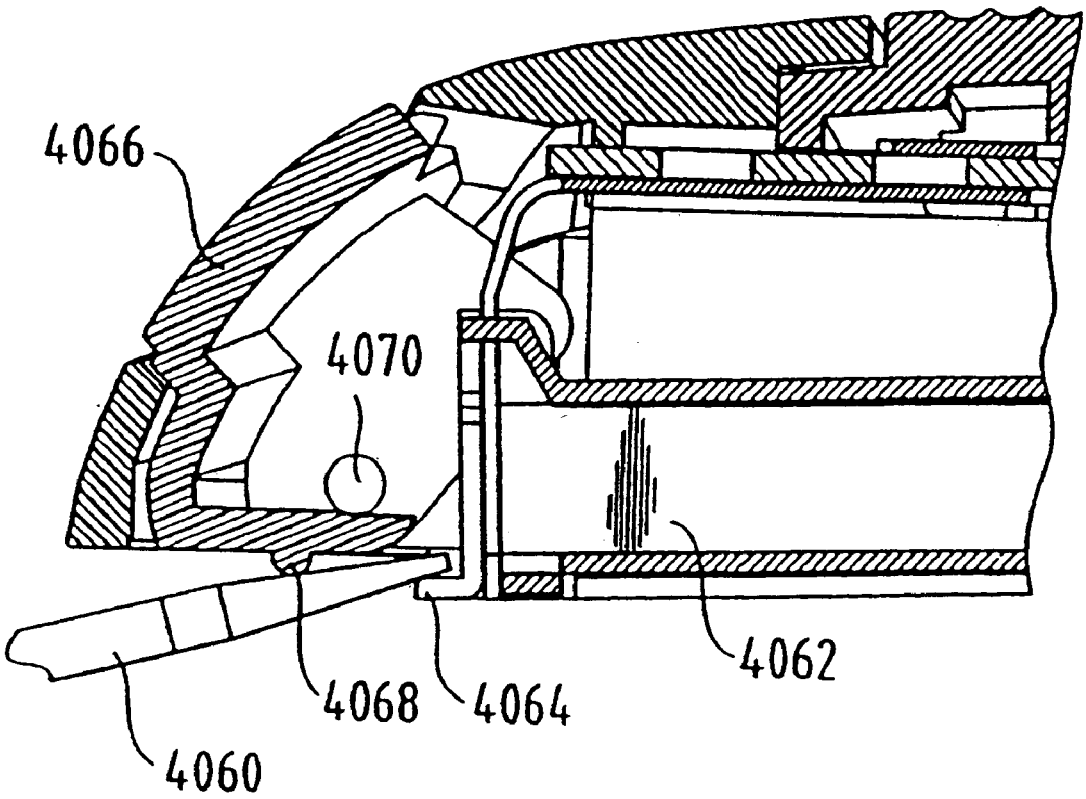
Figure 48:
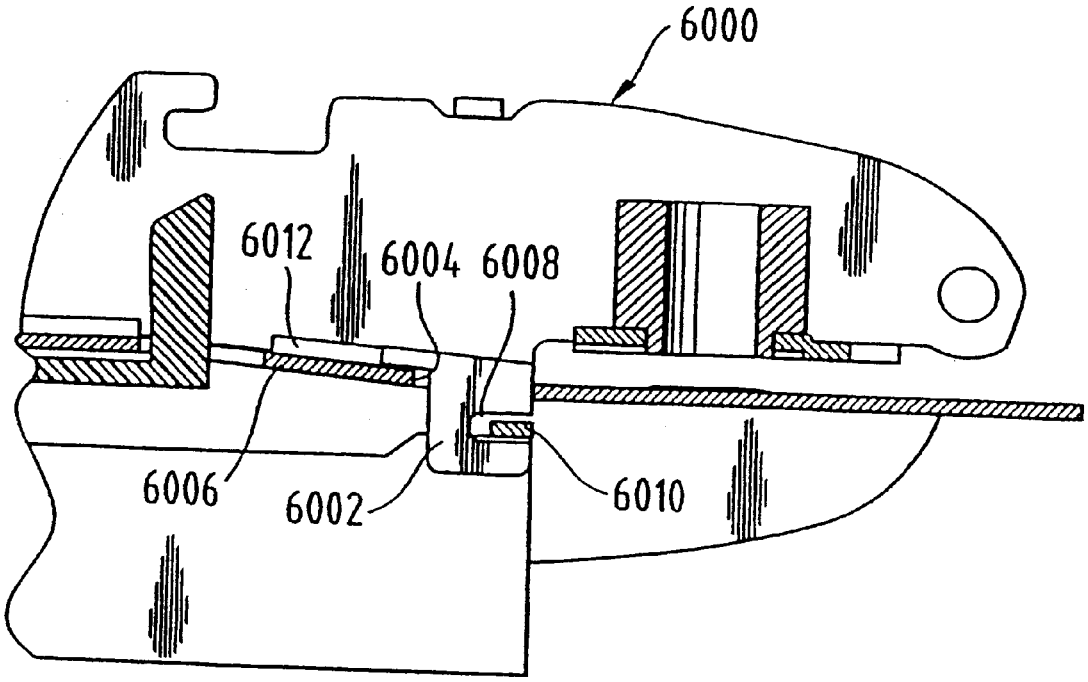

FIGS. 22 to 25 illustrate, partially in section, details of a stapler-release mechanism, FIG. 26 shows an exploded illustration of a further implement according to the invention, FIG. 27 is a longitudinal section of the implement according to FIG. 26, FIGS. 28 and 29 show details of the anvil and support stage in plan view, FIGS. 30 and 31 show, in longitudinal section, details of the anvil arrangement and of the support stage, FIGS. 32 to 34 show, in longitudinal section, configurations of the punch, FIG. 35 shows another configuration of the stapler-release arrangement, in longitudinal section, FIG. 36 illustrates, in longitudinal section, a further configuration of the chad container, FIGS. 37 to 40 illustrate, in schematic longitudinal sections and cross sections, the construction of the module according to the invention, FIGS. 41 to 47 show alternative configurations of individual members, FIG. 48 shows an alternative to FIG. 12.

Two basic concepts are provided, namely an "integrated" variant and a "modular" variant. In the case of the integrated variant, all the members are installed one after the other in an order determined by the most expedient operating sequence. In the case of the modular variant, a stapler and/or hole puncher module and a utensil module are each individually pre-installed, attached and provided with coverings.

FIG. 1 is a perspective view of an implement 800 according to, the invention, comprising two members 1, 2 including a stapler and hole puncher mechanism, in the transportation state, i.e. the state in which it is closed with all the utensils in the swung-in position. While the stapler and hole puncher mechanism will be explained at a later stage in the text, the tools knife 802, scissors 804 and staple remover 806 can be swung out of a receiving space, provided in the lower part of the implement, about a common pivot pin 808. The receiving space for the utensils is covered by a cover 812, which is essentially flush with the outer contour of the implement. Normally, only one tool is swung out and, for the purpose of simplified handling, the cover is closed. It is only to aid understanding that FIG. 2 shows the cover open, the knife 802 swung out and the staple remover 806 pivoted through only 90°. Springs (not shown) may be provided in order to keep the tools biased to their storing position and/or their working position. In FIG. 3, the implement is modified such that the cover 820 pivots about an axis which is parallel to the longitudinal axis of the implement. The spring 822 biases the cover into the open position, and the locking means 824 secures it in the closed position. It would also be possible for the cover to be omitted or designed as a sliding cover, e.g. a shutter-like cover.

An exemplary embodiment of a modular implement having a stapler/hole puncher assembly and a utensil module, which is inserted as a separate assembly into said stapler/hole puncher assembly, will now be explained with reference to FIGS. 4 to 25. FIG. 4 shows the complete implement in a perspective view with the knife swung out, FIG. 5 shows the utensil module as a separate entity, FIG. 6 shows a side view of the implement, FIG. 7 shows a longitudinal section and FIG. 8 shows a cross section. FIG. 9 is an exploded illustration in which, in many cases, reference can also be made back to details of the above-described integral construction and/or of the abovementioned earlier application.

First. FIGS. 7 to 14 are considered together.

Provided in the upper shell 2000, made of plastic, are cutouts for the passage of ah opening button 2002, of a stapler-release button 2004 and of a staple-magazine button 2006. The opening button 2002 interacts with a leaf spring 2008 which is guided in a longitudinally displaceable manner on the upper part 2010 and keeps the two members locked in their first position. In this respect, reference may be made to the disclosure of the abovementioned earlier application. The upper shell has a curved top surface 2001 and planar lateral walls 2003, which are set back somewhat and covered by screens 2012. The upper part 2010 has lugs 2014 with bearing bores 2016, through which the main pivot 2018 passes in the installed state. The locking hook 2020 for the stapler-release button 2004 is mounted on the upper part 2010 by means of pin 2022, in front of which the staple driver 2024 is fastened. The upper part 2010, which is in the form of an upside-down U in cross section, receives the staple channel 2026, which can likewise be pivoted about the main pin 2018 and in which the staple magazine 2028 is guided in a longitudinally displaceable manner. The upper element of the stapling mechanism is completed by the rod 2030, pressure-exerting element 2032 and compression spring 2034 for advancing the staples; the details of the construction can be gathered from the abovementioned earlier application. Also mounted on the staple channel, pivotably about pin 2038, is the unblocking lever 2036 of the "flat-clinch mechanism", said lever being biased into the blocking position by spring 2040. Finally, the staple channel also has aligned slots 2042, in which the unblocking pin 2044 is guided displaceably. The unblocking pin 2044 engages into the catch 2046 of the staple magazine 2028 and can be displaced into the release position by the tilting lever 2048, which is normally retained in the blocking position by spring 2050, if the staple-magazine button 2006 is pushed. The tilting lever 2048 is also mounted on the main pin 2018.

The upper member is supported on the lower member via the staple channel and the main spring 2052.

The lower member comprises the lower part 2054 which is angled in the form of an upside-down U and, moreover, has an offset in height between the stapler side and the hole puncher side. Formed on the stapler side is an aperture 2056 for receiving the stapler support stage 2058 and the anvil 2060. Provided beneath the aperture is a supporting plate 2062 on which the anvil is supported. The blocking slider 2064 projects with its fork-shaped front end 2066 into the space between the supporting plate 2062 and lower part 2054. The release button 2068 projects through the corresponding aperture 2070 of the stapler support stage. Finally, the actuating arms 2072 of the blocking slider extend upwards, through the apertures 2074 of the lower part, into the path of the unblocking lever 2036 when the latter is deflected.

The construction of the "flat-clinch arrangement" in the lower member is illustrated in more detail in FIG. 10. As is known, the stapler support stage 2058 in such an arrangement ensures that, when a staple is ejected from the staple channel, its legs first of all pass through the stapling material without striking against the anvil; it is only when the unblocking lever, which senses the relative angle between the upper part and staple channel, has displaced the blocking slider 2064 inwards that the fork-shaped end 2066 of the latter yields inwards and thus permits the stapler support stage to tilt downwards and the staple to come into contact with the anvil 2060.

The tilting articulation of the stapler support stage 2058 is defined by the inner end of the stapler support stage, the said end being designed as a fork 2076 and being pushed over the inner transverse edge 2078 of the aperture 2056. This permits longitudinal displacement of the stapler support stage during tilting. For reasons which will be clarified from the description of FIGS. 28 and 29, the through-passage opening 2080 of the stapler support stage is of approximately oval form, adapted to the outline of the bead-like thickened head 2082 of the anvil 2060. This gives linear contact between the head and the inner wall of the through-passage opening 2080, which makes it possible for the gap between the two to be kept minimal over the entire pivot path, in order that the risk of a staple jamming between the two is low. The stapler support stage is pushed upwards by a spring 2084 which is plugged onto the post 2086 of the supporting plate 2062 and a mating post 2087 of the stapler support stage. The upper end position is defined by the stops 2088 resting, in the through-passage opening 2080, against the underside of the head 2082. Clamped in between a lower projection 2090 of the stapler support stage and an upwardly projecting extension 2092 of the blocking slider 2064 is a compression spring 2094 which, on the one hand, keeps the stapler support stage 2058 in engagement with the front edge of the head 2082 of the anvil 2060 and, on the other hand, pushes the blocking slider 2064 into its blocking position. During installation, the anvil 2060 is inserted through the through-passage opening 2080 and riveted in an aperture 2096 of the supporting plate 2066.

The U-base 2100 of the lower part 2054 has a first planar section 2102 with the aperture 2056, a second planar section 2104, which is at a lower level than the first planar section and is parallel thereto, and a sloping section 2106, which connects the other two sections and in which there is formed a hollow 2108 in which the main spring 2052 (if it is designed as a coil spring in accordance with FIG. 7) is positioned and supported on an inner flange 2110.

A bearing bracket 2112 is fastened on the U-base 2100. The block is a part which has been formed by punching and bending and has a U-shaped contour. The U-base comprises an inner transverse web 2114, a central aperture, through which the main spring 2052, which is designed as a coil spring, also extends, and an outer transverse web 2116 with a smaller aperture, into which a guide bush 2118 for the punch 2120 is inserted. The two transverse webs of the block are located in a common plane, with the result that a gap for receiving papers which are to be punched is produced between the second planar section 2104 and the outer transverse web 2116. The contour of the lower border of the U-legs 2122 follows the slope of the section 2106, but has in each case one fastening tab 2125, which is bent inwards through 90° and is parallel to the sloping section 2106, and one double hook 2126 on both sides. Above the double hooks, the contour of the block forms a stop for the purpose of positioning papers which are to be punched. During installation, these double hooks are inserted through in each case one slot 2124 of the lower part, and then the block is pushed outwards until the outer hook sections 2128 of the double hooks engage beneath the second planar section 2104. In this position, the inner transverse web 2114 and the fastening tabs 2125 are connected to the lower part, e.g. by spot welding.

Inwardly angled tabs 2170 are integrally formed on the upper free edges of the U-legs, and the upper part 2010 has lateral hollows 2172 into which in each case one integrally formed hook 2174 projects. The tabs and the hooks form stops and mating stops which delimit the opening angle between the upper part and the lower part.

The planar section 2104 of the lower part also has an aperture 2130, into which the light guide 2132 intended as a positioning aid for the hole puncher projects, as well as the hole die 2134 which interacts with the punch 2120. The details can be seen in FIG. 15. Unlike the configuration in the earlier application which has already been mentioned a number of times, the punch 2120 is held in position, by a leaf spring 2136, against the curvature 2138 of the upper part in order that said punch does not project into the hole puncher gap 2139 even when the stapler is activated, that is to say the staple channel 2026 is lowered. The hole puncher gap for papers which are to be punched is terminated at the top by a thin covering plate 2140.

Finally, the lower member further comprises the utensil module 2180, which is fitted on the supporting plate 2062 via front fitting means 3002 and on the inner end sections 5500 of the double hooks 2126 via rear fitting means 3004, and also comprises the lower plastic shell 2142 with the cover 2144 for the compartment for receiving the chads, referred to here and below as "confetti", punched out by means of the punch 2120.

As can be seen in FIG. 8, free spaces are provided between the outer walls of the module and the inner sides of the U-legs of the lower part 2054, and additional functional parts of the module are located in these free spaces. The lower plastic shell engages around the free edges of the U-legs and the free edges of the module outer walls and covers the free spaces towards the outside. At the locations where the utensils are to be swung out of the module, the lower plastic shell has cutouts, so as to define a plane for the purpose of setting down the implement.

In the case of the above-described embodiment, the division of space is of particular importance, since the dimensions of the implement can be optimized as a result. The graduation in height of the lower member makes it possible to provide the necessary displacement for the punch above the hole die, while the height requirement for the chad container may be relatively low. On the other hand, the utensil module requires more height, and the anvil-side members of the stapler, in particular when the latter is provided with a "flat-clinch arrangement", also require a certain amount of space in the lower member, while the space requirement for the staple channel and the staple driver as well as the locking mechanism, in contrast, is relatively low. In addition, fastening tabs of the bearing bracket and the supporting means for the main spring, which biases the two members in the opening direction, are located above the module. Consequently, the module is fitted at a distance from the base surface of the second member. This construction also results in different planes for the purpose of positioning the papers which are to be stapled, on the one hand, and the papers which are to be punched, on the other hand.

Without the offset in height presented here, the implement would end up being significantly higher without gaining any functional advantages therefrom.

In addition, in an embodiment with a stapler and a hole puncher, there is an optimum utilization of space in the longitudinal extent of the lower member, with the receiving space for the assembly of the utensils on one end side and the receiving space for the chads from the hole puncher on the other end side, which spaces adjoin one another, and with the option of installing a positioning window for the hole puncher between the two receiving spaces.

Three configurations of the confetti compartment and its cover are illustrated in FIGS. 16 to 21. The principle consists in signalling to the user that it is necessary for the compartment to be emptied before the cover is forced open by the accumulated confetti.

FIG. 18 shows, in section, the confetti compartment with the cover 2144 closed. In each case one leaf spring or wire spring 2146 on both sides of the light guide 2132 pushes on the projections 2145 integrally formed on the cover and keeps the cover closed. If the confetti pushes on the cover on the inside, said cover is first of all lifted off from the confetti compartment somewhat counter to the spring bias, as is shown in FIG. 17, as a result of which it is brought to the user's attention that the compartment is full; the sealing lip 2148, however, ensures that confetti does not drop out, since the cover is still kept closed by the springs 2146. The springs have bulged-out sections 2150 which the projections 2145 have to run over before the cover springs, under the action of the springs 2146, into the open position according to FIG. 16. These bulged-out sections then also keep the cover in the open position, which is illustrated in FIG. 16.

In the embodiment according to FIG. 19, use is made of leg springs 2152 which constantly push the cover into the closed position, thus ensuring that the cover is always closed following the opening operation.

While in the case of the two embodiments described here the cover is articulated about a pin 2154 on the housing, it is the case for the embodiment illustrated in FIGS. 20 and 21 that the ends of the leg springs 2156 are angled and themselves bear the cover. This is logistically advantageous and makes it possible for the cover to be pivoted open through almost 180°, as is shown in FIG. 20.

Figure 22:
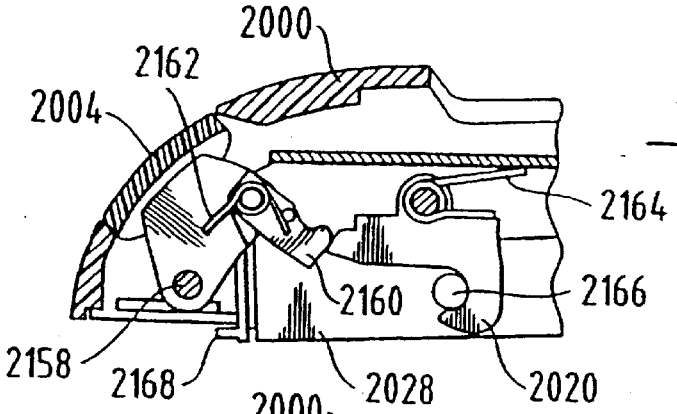
Figure 23:
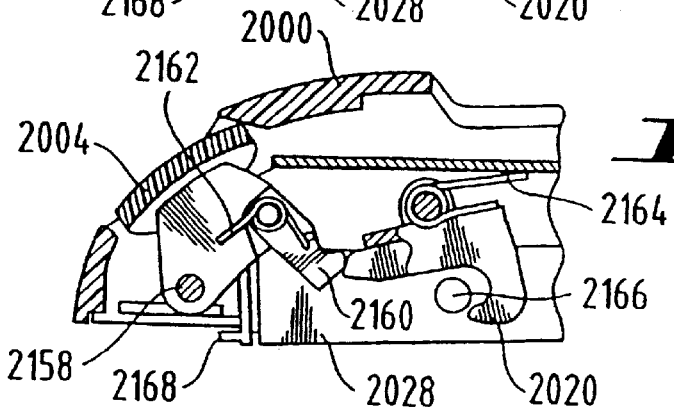

FIGS. 22 to 25 illustrate the means for activating the stapler as well as the interaction of the stapler button 2004 with the locking hook 2020. FIG. 22 shows the initial position. Button 2004 can be pivoted about pin 2158 against the bias of a spring (not shown here) and has articulated on it a lever 2160 which, biased by spring 2162, is held in position against a stop (not shown). The locking hook 2020 is biased by spring 2164 into the locking position and secures the locking pins 2166, provided on the staple channel, and thus the staple channel itself in its upper position. When pressure is exerted on the button, the locking hook releases the pins 2166 and pivots back into its initial position even if the button 2004 is kept pressed down; if the button is kept pressed down during stapling, it is nevertheless possible for the hook to pivot back into its initial position, in which case it deflects the lever 2160 somewhat; this is shown in FIG. 24. If the button is released once the locking hook 2020 has been pivoted back into its initial position, the lever can pass the locking hook, with deflection against to the bias of the spring 2162, into the correct initial position according to FIG. 22, as is shown in FIG. 25. If, for any reason, the staple channel is jammed in the upper part, the locking lever can only be deflected until it strikes against the staple channel, in which case it remains in the open position as a result of the button being pressed; this is shown in FIG. 23. Manipulation, for example using a tool or the like, of the angled section 2168 allows the staple channel to be released, since the locking hook has already released the pins 2166 to the extent where the staple channel can move.

FIGS. 26 and 27 relate to an inventive implement of integrated construction, as defined above. FIG. 26 is an exploded illustration, while FIG. 27 illustrates a central longitudinal section. In the case of this implement, one of the utensils, namely the staple remover, cannot be swung out but instead is guided displaceably on the underside of the implement, while in each case at least one further, swing-out utensil is accommodated in lateral channels. The advantage of this configuration is that the staple remover thus immediately moves into a convenient working position.

FIG. 26 shows the skeleton of the implement. From top to bottom, the implement comprises an upper plastic shell 910 with a curved top surface 912 and planar lateral walls 914 which are set back somewhat, a cavity being delimited as a result. Metallic screens 916 engage over the side walls 914. An upper part 918 and an outer channel 920 are installed pivotably on the main pin 922. The outer channel 920 retains the staple carrier 924. The upper part 918 has a section 926 for the actuation of the punch 928, which is guided in a bore 932 of a sliding bearing 930, the latter being made preferably from aluminium or magnesium. The sliding bearing 930 is pressed into a corresponding opening of the block 934. The block 934 is installed on a combined base 936 by means of three rivets, the holes of which are marked by 938.

The lower part 936 comprises a base part 940 and a covering part 942, the latter being fastened rigidly on the base part, for example by means of spot welding. The base part 940 comprises a bottom wall 944, a top wall 946 and side walls 948 which connect the top wall and the bottom wall, thus forming a rigid channel-like profile. The top wall 946 is recessed for receiving the anvil 950 and support stage 952 (FIG. 27). The bottom wall is recessed for receiving the confetti compartment 954, which is formed integrally with the lower plastic shell 956. The bottom wall 944 has an elongate slot for guiding a staple remover 966, and in each case one utensil can be swung out of the channels formed between the side walls 948 and the covering part.

The staple remover 966 has a grip piece with a contour which is complementary to a recess 968 of the lower shell 956. The staple remover latches in its rest position and can be released by means of a push button 967. A nose 957 interacts with the staple remover in order, when the staple remover is pushed in, to eject a removed staple which is seated on said staple remover. The lower shell 956 is installed on the bottom wall 944 by means of a screw 970 and snap-on arms 972. Furthermore, the top wall 946 has an integrally formed tubular rivet 960, which also retains the lower shell 956, in the vicinity of the punch 928.

Looking now at FIGS. 28 to 36, alternative configurations of individual parts or assemblies will be explained.

The punch 928 (FIG. 26) or 2120 (FIG. 9) expediently comprises a tube part 962 and a plastic cap 964 with a cylindrically curved upper side, which are connected to one another by a snap-in action (FIGS. 27 and 34), a moulding-on operation (FIG. 32) or a press-fit connection (FIG. 33). This achieves linear contact between the rounded head of the cap and bead 926. At lateral projections 929 of the cap (FIG. 26), the stapler channel 920 engages beneath the punch and thus draws it upwards following a punching operation.

FIGS. 28 to 31 show devices that can largely prevent the jamming of staples or, if a staple actually does jam, can remove the latter again conveniently.

If a staple jams between the anvil 950 (FIG. 26) and the support stage, the removal of a staple which has jammed in this way is facilitated in that a recess 1000 is provided in the support stage 952 such that the blocking part 1002 is accessible. A projection 1004 of the part 1002 expediently extends into the recess 1000. The blocking part 1002 can thus be displaced manually in order that the support stage 952 can be pushed down manually and the jammed staple is freed. Alternatively, or additionally, the adjoining surfaces of the anvil and support stage may be contoured instead of being planar, and thus prevent the penetration of staples. As an example, FIG. 29 shows serrated contours of the anvil 950, which interact with a complementary opening of the support stage. It would also be possible for a curved contour (FIG. 28) to serve the same purpose. When a staple is clamped in, the support stage may be jammed in its pushed-down position. Release of the support stage is then facilitated by the provision of a nose 1006 and a recess 1008 in the base plate 942, which recess permits access to the nose 1006 from beneath in order thus for the support stage 952 to be drawn out (FIGS. 28 to 31).

Similarly, according to FIG. 35 a staple could jam in the staple channel 920 if a user were to try stapling very hard material and the channel were to remain hanging in the upper part 918 (FIG. 26) although the button 1010 has been pushed down. In order to simplify manipulation of the channel, the button 1010 and the lever 1012 may be formed such that the lever has a projection 1014 which acts directly on the channel 920 in order, when the button 1010 is pressed, to displace said channel downwards out of the upper part and thus to release the jamming. It would also be possible for a nose 1011 to be provided on the end side of the staple channel 920, so that said channel could be drawn down by the nose in the event of jamming.

FIG. 36 is a partial longitudinal section for the purpose of illustrating a modified design of the receiving compartment for the chads of the hole puncher, i.e. of the cavity in which paper chads, which have been punched out by means of the punch 928, are collected. The design differs from those described above in that the cover 1016 is connected in an articulated manner to the body of the lower shell 956 by means of a polypropylene strip 1018 which is joined to the cover or the rear wall 1020. The correct fit of the cover when it is closed is ensured by arms 1022, which engage in openings of the rear wall 1020 to the side of a light guide (which can be seen in FIGS. 9 and 27), and by the two-position locking means 1024. A rib 1026, which is arranged beneath the hole die in the receiving compartment, deflects incoming paper chads, in order thus to render the filling of the receiving compartment more uniform.

With reference to FIGS. 37 to 40, the utensil module will now be explained. In this exemplary embodiment, said module comprises two planar congruent outer walls 3000 each with two assembly hooks 3002 and 3004, respectively. The hooks 3002 are fitted on the supporting plate 2062 (FIG. 9), while the hooks 3004 are brought into engagement with the double hooks 2126 of the block. Laterally projecting projections 3006 (FIG. 5) keep the module centred in the lower part (FIG. 5), and said module is secured in the installed position by virtue of lugs 3008 being bent out (FIG. 11). As in the exemplary embodiment, the space between the outer walls can be subdivided, by thinner intermediate walls 3010, into individual compartments for in each case at least one utensil.

The utensils can be swung out about a common pin 3012, and the blade of a knife 3014 is shown in FIGS. 37 to 40 as an example for the purpose of explaining the functions. Leaf springs 3016 rest with their head 3018 against the foot 3020 of the relevant utensil and keep the latter either in the swung-in position, as is shown in FIG. 37, or in the swung-out position according to FIG. 39. During the swinging movements, sliding friction acts between the spring head and utensil foot (FIG. 38). In this respect, there is similarity with pocket knives, from which it is also possible to derive the geometry of the outline of the spring head, on the one hand, and of the utensil foot, on the other hand. The springs are designed as two-armed levers; their articulations are formed by rivets 3022, and the lever arm 3023 which is directed away from the head 3018 is supported on the rivet 3024.

In the mounted state, the utensils, and any lamellae 3010 provided between them are located, with essentially congruent contours, in a recessed position with respect to the plastic shell. Close to the swing-out axis, the module is laterally supported by protrusions on the insides of the U-legs of the lower part 2054, for example rivet heads 3025 (FIG. 5), in order to avoid torsional deformation.

A number of variants on the exemplary embodiments described above will be explained with reference to FIGS. 41 to 47.

Figure 41:
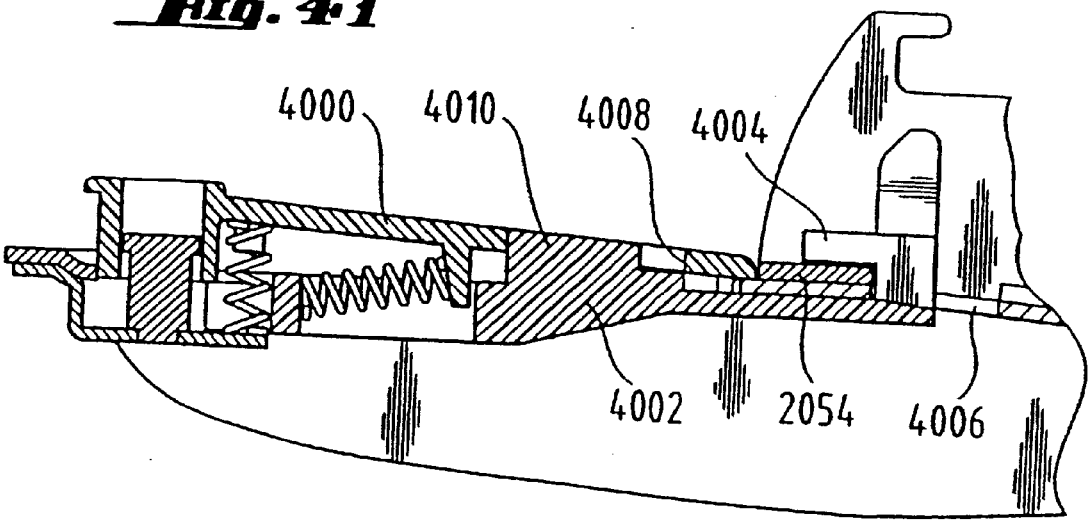
Figure 42:
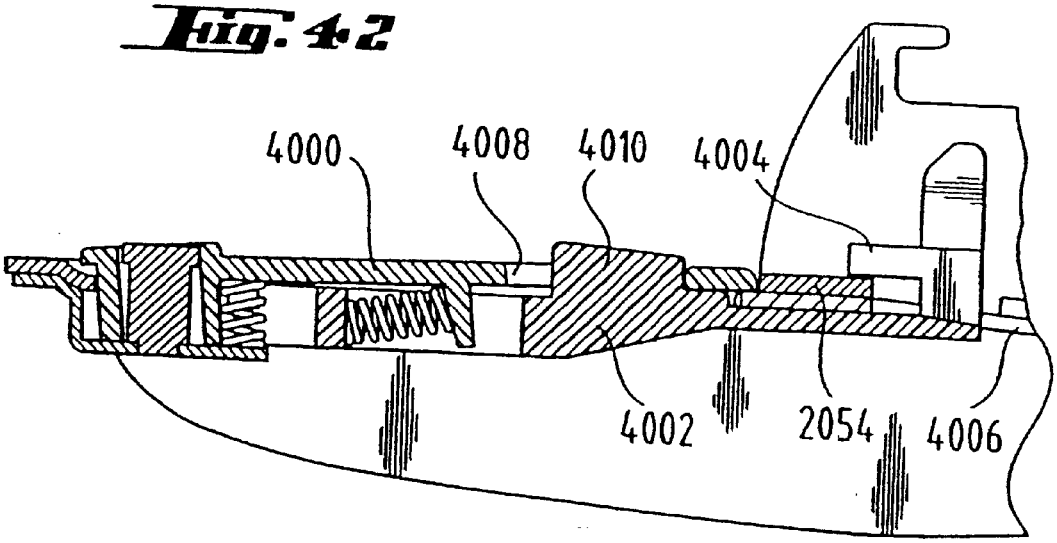

FIGS. 41 and 42 show, in partial longitudinal section, the stapler support stage 4000 and the blocking angle piece 4002 with the support stage in the supported and pressed-down positions, respectively. The blocking angle piece has angled sections 4004 which from below are pushed through and then over the base surface of the lower part 2054 through the slots 4006, which have been somewhat extended for this purpose. The aperture 4008 of the support stage then engages over the projection 4010 of the blocking angle piece and forms the stop for the release position of the blocking angle piece (FIG. 42), in which the angled sections are still supported.

Figure 43:
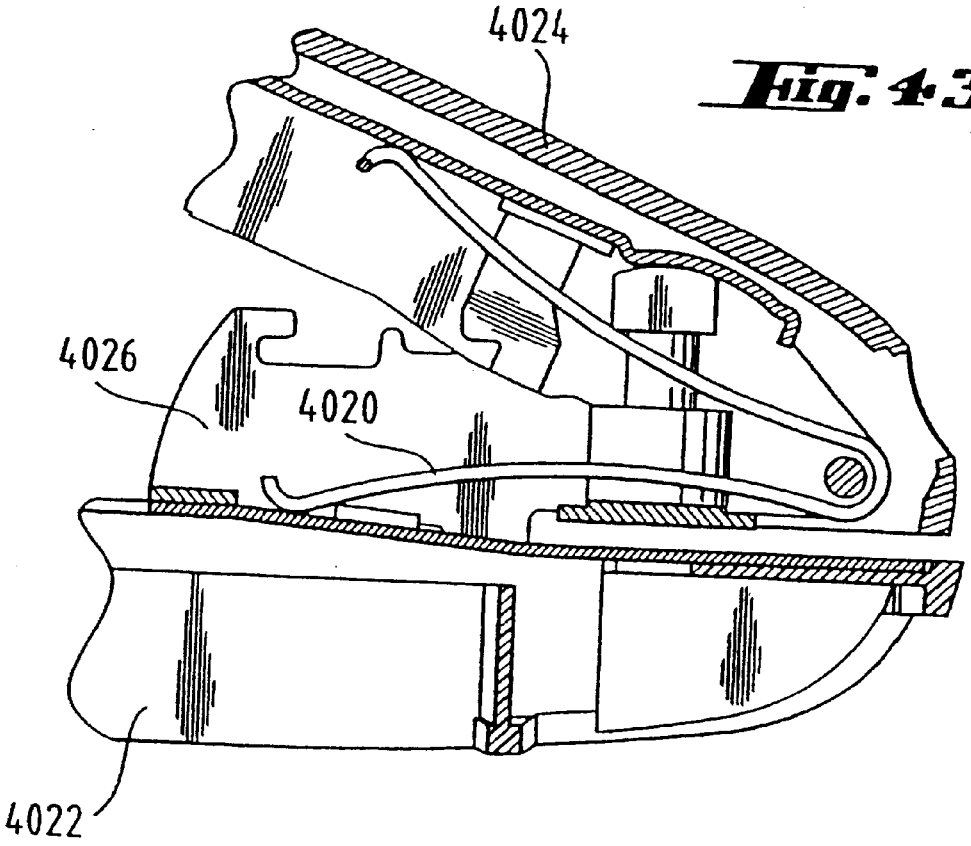

FIG. 43 shows a partial longitudinal section in the area of the hole puncher. The main spring is in this case designed as a powerful bent double-wire spring 4020 which is supported on one side against the lower part 4022 and on the other side against the upper part 4024 and penetrates through the block 4026, cf. also FIG. 9.

Figure 44:
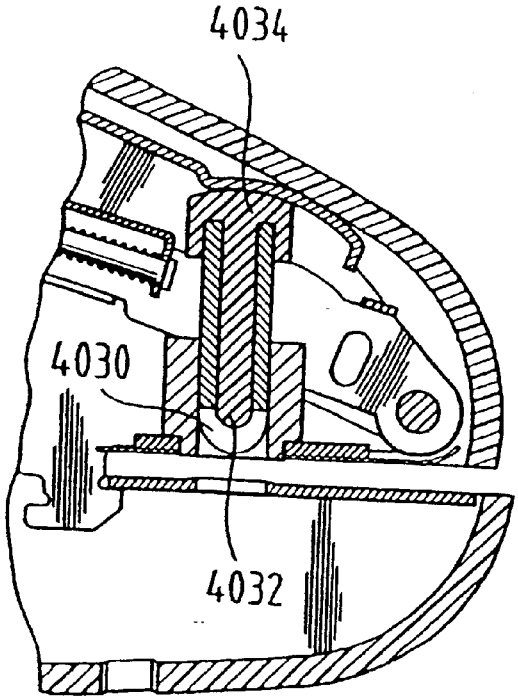

FIG. 44 shows, in partial longitudinal section, a modified form of the punch. Its cutting part is delimited by a ground-in groove 4030. As a result, confetti which has been cut out can become trapped in this groove, particularly if relatively sturdy material is being punched. To prevent this, the punch contains an ejector 4032 which projects into the groove and presses on the centre of the chad before its outer contour has been completely cut through, thus directing the chad towards the confetti compartment. Consequently, after the cutting operation has finished, it is forced away from the punch by dint of its own elasticity. Advantageously, the ejector is formed integrally with the cap 4034 and is press-fitted into the hollow punch.

Figure 45:
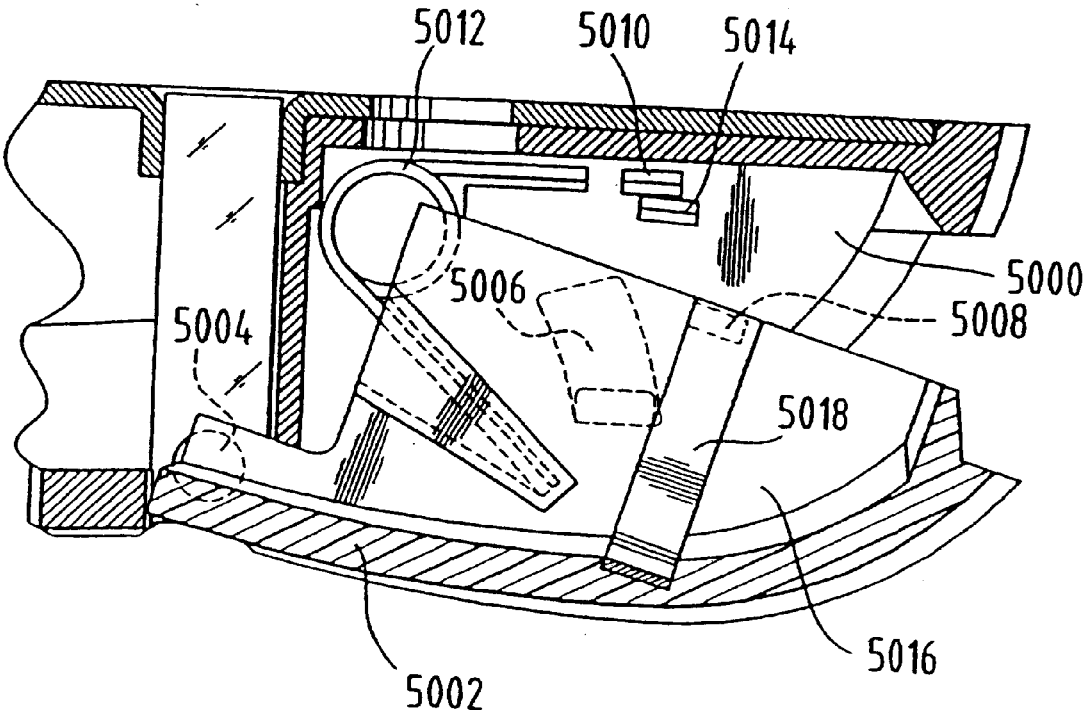

FIG. 45 shows a partial longitudinal section and FIG. 46 a partial cross section of a preferred configuration of the receiving compartment for the chads from the hole puncher. The compartment 5000 is moulded onto the lower plastic shell and is provided with a flap of U-shaped cross section 5002, which flap can be displaced out of a closed position into the emptying position illustrated in the drawings by powerful articulations 5004; the open limit position is fixed by the stop arrangement 5006 between compartment and flap. The closed position is secured by the fact that the boss 5008 latches into the latching notch 5010; in this position, the flap is biased by the leg spring 5012.

When the compartment fills up, the chads exert pressure on the flap until it is released from the latching notch 5010 counter to the spring force. However, the flap only opens through a small angle, since the boss 5008 latches into a second latching notch 5014. In this position of the flap, it is still impossible for any chads to fall out of the compartment, since the side walls 5016 of the flap and its end side still cover the opening gap. However, the fact that the flap is no longer flush with the body of the implement provides the user with a warning that it is time to empty the compartment. In order to ensure that the side walls 5016 bear securely and that the flap latches into the latching positions over a prolonged period, so as to protect against the penetration of chads, a metal spreader member 5018 is fitted in the flap, which spreader member is U-shaped in cross section and presses outwards by means of its U-legs.

Finally, FIG. 47 shows how a jammed staple channel 4062 is released by means of a tool 4060, for example a screwdriver, by pressing on its nose 4064. Of course, this only works when the stapler-release button is depressed; otherwise, the implement would be damaged. In this case, the release button 4066 is provided with a nub 4068 which, as seen from the staple channel, lies beyond the button articulation 4070, so that when the tool is brought into contact with the nub 4068 from below, the button is rotated clockwise and thus moves into the release position.

Where the above description uses the term "utensils", this term is to be understood in the broadest possible sense and comprises tools, measuring implements, illumination devices and other equipment which is desirable and useful in particular for office work.

The invention can be used for various implements, some of which are defined below:

Multipurpose hand-held implement, in particular for office work, having a first member and a second member which are connected movably to one another and can be moved between a first position, in which they form together, with essentially congruent contours, an elongate, essentially closed-off cuboidal body, in the case of which the two members are located one above the other with base surfaces directed towards one another, and a second position, designed in such a manner that

- one of the members has a staple magazine and a staple driver of a stapler and the other member has an anvil for bending round the ends of ejected staples, and/or
- one of the members has a punch and a hole die of a hole puncher, and the other member has a pressure lever for actuating the punch,
- in the second position, the members form a free space between the base surfaces, for working with the stapler and/or hole puncher, by relative movement of the members,
- at least one of the members is designed as a hollow body in which further tools are accommodated in such a manner that they can be displaced out of a storing position into a working position, and
- means are provided for securing the members, in a manually releasable manner, in the first position, in which they together form a grip for handling the further tools.

As an alternative, the implement may be a multipurpose hand-held implement, in particular for office work, having a first member and a second member which are connected movably to one another and can be moved between a first position, in which they form together, with essentially congruent contours, an elongate, essentially closed-off cuboidal body, in the case of which the two members are located one above the other with base surfaces directed towards one another, and a second position, designed in such a manner that

- one of the members has a staple magazine and a staple driver of a stapler and the other member has an anvil for bending round the ends of ejected staples, and/or
- one of the members has a punch and a hole die of a hole puncher, and the other member has a pressure lever for actuating the punch,
- in the second position, the members form a free space between the base surfaces, for working with the stapler and/or hole puncher, by relative movement of the members,
- means are provided for securing the members, in a manually releasable manner, in the first position, in which they together form a grip for handling the further tools.

A further variant is a multipurpose hand-held implement, in particular for office work, having a first member and a second member which are connected movably to one another and can be moved between a first position, in which they form together, with essentially congruent contours, an elongate, essentially closed-off cuboidal body, in the case of which the two members are located one above the other with base surfaces directed towards one another, and a second position, designed in such a manner that one of the members has a staple magazine and a staple driver of a stapler and the other member has an anvil for bending round the ends of ejected staples, the members, in the second position, form a free space between the base surfaces for stapling by means of relative movement of the members, after each stapling operation, the stapler is automatically deactivated and can be manually activated, and means are provided for securing the deactivated stapler, in a manually releasable manner, in the first position of the members.

Another variant is a multipurpose hand-held implement, in particular for office work, having a first member and a second member which are connected movably to one another and can be moved between a first position, in which they form together, with essentially congruent contours, an elongate, essentially closed-off cuboidal body, in the case of which the two members are located one above the other with base surfaces directed towards one another, and a second position, designed in such a manner that the two members are designed as shell-like hollow bodies with essentially mirror-symmetrical outer contours which are delimited by a base surface, a top surface, two lateral surfaces and two front surfaces, the base surfaces of which, in the first position, are spaced apart from one another and delimit a chamber which is accessible from both front surfaces, the two members are connected in such a manner that they can pivot about a pin which runs parallel to the base surfaces and perpendicular to the longitudinal extent of the member, means are provided for locking the members, in a manually releasable manner, in the first position.

The implement may also be a multipurpose hand-held implement, in particular for office work, having a first member and a second member which are connected movably to one another and can be moved between a first position, in which they form together, with essentially congruent contours, an elongate, essentially closed-off cuboidal body, in the case of which the two members are located one above the other with base surfaces directed towards one another, and a second position, designed in such a manner that the second member comprises a support stage with a hole die, a punch guide with a punch and a stop which limits the depth to which material to be punched can be pushed in, and the first member has a pressure ram for actuation of the punch, one of the members has a window through which it is possible to see the area of the support stage between hole die and stop, for the purpose of lateral positioning of material which is to be punched, means are provided for locking the members, in a manually releasable manner, in the first position.

The implement may also be a multipurpose hand-held implement, in particular for office work, having a first member and a second member which are connected movably to one another and can be moved between a first position, in which they form together, with essentially congruent contours, an elongate, essentially closed-off cuboidal body, in the case of which the two members are located one above the other with base surfaces directed towards one another, and a second position, designed in such a manner that the first member contains functional elements of a first tool and the second member contains further functional elements of both tools, both members can move in guided fashion relative to one another in order for the tools to be actuated and can be displaced out of the second position into the first position counter to spring preloading, means are provided for securing the members, in a manually releasable manner, in the first position, the said means comprising a first unlocking member, actuation of which activates one of the tools and deactivates the other which, however, can be activated by actuation of a second actuating member.

Finally, the implement may be a multipurpose hand-held implement, in particular for office work, having an elongate, essentially closed-off cuboidal body which has functional elements of a stapler and/or a hole puncher, which implement is designed in such a manner that the body has at least one insertion slot for material which is to be stapled or punched, which slot is accessible from one end side, an actuation member for stapler and/or hole puncher can be displaced out of a first position, in which it is essentially flush with the contour of the body, into a second position under spring preloading, and means are provided for securing the actuation member, in a manually releasable manner, in the first position.

FIG. 48 shows part of a structure as is illustrated in a similar manner in FIGS. 11 to 14. The bearing bracket 6000 has a lug 6002, which is pushed through an associated slot 6004 of the base plate 6006, on each of its two U-legs. Both lugs are provided with a cutout 6008 which is open in the direction of the chamber which is provided for the hole puncher chads and into which laterally projecting projections 6010 of the relevant outer wall of the module are fitted. The bearing bracket is fastened by spot-welding the inwardly angled projections 6012 onto the base plate.

What is claimed is:

1. A multipurpose hand-held implement comprising: a first member and a second member, said first and second members being connected together to move between a first position, in which they form together an elongated body, and a second position, wherein said first and second members comprise a staple magazine, a staple driver and a staple anvil of a stapler, said members, when in the second position, forming an interspace to receive a workpiece for processing by the stapler as the first and second members are moved relative to one another, further tools which can be swung out are accommodated in a storing position in at least one of said members, and said first and second members, when in said first position, together forming a grip for handling of the further tools when swung out, wherein the at least one of said members accommodating at least some of the further tools comprises a receiving space open to the exterior, said receiving space accommodating an assembly of a plurality of the further tools, which can be swung out about a common axis at a front side of said member.

2. The implement according to claim 1, characterized in that means are provided for securing the members, in a manually releasable manner, in the first position.

3. The implement according to claim 1, characterized in that an edge of a recess, which delimits the receiving space, forms a surface upon which the implement can stand.

4. The implement according to claim 1, characterized in that a base surface of the member which accommodates the assembly comprises a first planar section and a second planar section which is offset in terms of height with respect to the first planar section.

5. The implement according to claim 1, characterized in that a common pin for the further tools is positioned close to a front surface of the member which accommodates the assembly.

6. The implement according to claim 5, characterized in that the pin is positioned in the area between the front surface of the member which accommodates the assembly and the anvil.

7. The implement according to claim 1, characterized in that the assembly is essentially aligned with regard to a longitudinal axis of the member which accommodates the assembly.

8. The implement according to claim 1, characterized in that the further tools, in their swung-in position, are located behind contours of front and top surfaces of the member which accommodates the assembly.

9. The implement according to claim 1, characterized in that the further tools latch into at least one of their swung-in position and their working position.

10. The implement according to claim 9, characterized in that the latching is effected by means of leaf springs which press on shanks of the tools in the area of the pin.

11. The implement according to claim 10, characterized in that the leaf springs are arranged between the tools and a base surface of the member which accommodates the assembly.

12. The implement according to claim 1, characterized in that the assembly is fitted into the body as a pre-assembled module.

13. The implement according to claim 12, characterized in that the module accommodates the tools between two parallel outer walls.

14. The implement according to claim 13, characterized in that an interspace between the outer walls is divided, by means of lamellae which are parallel to the outer walls, into compartments for in each case at least one tool.

15. The implement according to claim 13, characterized in that leaf springs for preloading the tools are arranged on pins, which run transversely with respect to the outer walls, on the module.

16. The implement according to claim 13, characterized in that the outer walls are connected by means of pins which run transversely with respect to the said walls and are riveted to the outsides of the outer walls.

17. The implement according to claim 13, wherein the outer walls define an interspace, wherein the interspace is divided by lamellae, wherein the lamellae and outer walls comprise respective contours, and wherein the respective contours are congruent with top and front surfaces of the first and second members.

18. The implement according to claim 12, characterized in that the module has means for fastening it to the body.

19. The implement according to claim 18, characterized in that the means comprise anchoring hooks which are arranged on outer walls of the module.

20. The implement according to claim 19, characterized in that the anchoring hooks are arranged on a side which is directed towards a base surface of the member which accommodates the module and close to the outer walls of the module and are fastened at attachment points of the member.

21. The implement according to claim 12, characterized in that free spaces for further functional elements are provided between the module and at least one of a lateral surface and base surface of the member which accommodates this module.

22. The implement according to claim 21, wherein the stapler comprises functional elements, and wherein the functional elements of the stapler are accommodated in the free space between the base surface and the module.

23. The implement of claim 1, wherein the common axis extends transversely to the direction in which said members are movable.

24. A multipurpose hand-held implement comprising: a first member and a second member, said first and second members being connected together to move between a first position, in which they form together an elongated body, and a second position, wherein said first and second members comprise a punch, a hole die and a lever of a puncher, said lever positioned to actuate the punch, said members, when in the second position, forming an interspace to receive a workpiece for processing by the puncher as the first and second members are moved relative to one another, further tools which can be swung out are accommodated in a storing position in at least one of said members, and said first and second members, when in said first position, together forming a grip for handling of the further tools when swung out, wherein the at least one of said members accommodating at least some of the further tools comprises a receiving space open to the exterior, said receiving space accommodating an assembly of a plurality of the further tools, which can be swung out about a common axis at a front side of said member.

25. A multipurpose hand-held implement comprising: a first member and a second member, said first and second members being connected together to move between a first position, in which they form together an elongated body, and a second position, wherein said first and second members comprise a staple magazine, a staple driver and a staple anvil of a stapler, said first and second members comprise a punch, a hole die and a lever of a puncher, said lever positioned to actuate the punch, said members, when in the second position, forming an interspace to receive a workpiece for processing by one of the stapler and the puncher as the first and second members are moved relative to one another, further tools which can be swung out are accommodated in a storing position in at least one of said members, and said first and second members, when in said first position, together forming a grip for handling of the further tools when swung out, wherein the at least one of said members accommodating at least some of the further tools comprises a receiving space open to the exterior, said receiving space accommodating an assembly of a plurality of the further tools, which can be swung out about a common axis at a front side of said member.

26. A multipurpose hand-held implement comprising: a first member and a second member, said first and second members being connected together to move between a first position, in which they form together an elongated body, and a second position, wherein said first and second members comprise a staple magazine, a staple driver and a staple anvil of a stapler, said first and second members comprise a punch, a hole die and a lever of a puncher, said lever positioned to actuate the punch, as well as a compartment for receiving punchings, said compartment being provided beneath said hole die, said members, when in the second position, forming an interspace to receive a workpiece for processing by the stapler and the puncher, respectively, as the first and second members are moved relative to one another, further tools which can be swung out are accommodated in a storing position in one of said members, and said first and second members, when in said first position, together forming a grip for handling of the further tools when swung out, wherein said compartment and the further tools are arranged behind each other in said one of said members accommodating the further tools.

27. The implement of claim 26, wherein a receiving space open to the exterior is provided for the further tools.

28. A multipurpose hand-held implement containing at least one tool of the group comprising a stapler and a puncher and comprising an elongated body;

wherein the body accommodates a plurality of further tools in a storing position, which can be folded out, the body forming a grip for handling said further tools in their folded out position;

wherein the body comprises a first and a second member being connected together to pivotably move about a first axis perpendicular to the longitudinal direction of the body between a first position and a second position;

wherein functional elements of the stapler comprise a staple magazine, a staple driver, a staple anvil and an actuating member for actuating the stapler and functional elements of the puncher comprise a punch, a hole die and an actuating member for actuating the punch, the stapler and the puncher each comprising a processing stage for a workpiece;

wherein at least one of the members comprises a common receiving space open to the exterior for accommodating an assembly of the further tools which can be folded out about a second axis;

wherein the members are movable about the first axis into the second position to open an interspace to receive a workpiece for processing, said first axis being parallel to the at least one processing stage; and wherein each of the members comprises at least one functional element of at least one tool of the group comprising the stapler and the puncher such that said at least one tool is actuatable by relative movement of the members between the first and second positions.

29. A multipurpose hand-held implement containing at least one tool of the group comprising a stapler and a puncher and comprising an elongated body;

wherein the body accommodates a plurality of further tools in a storing position, which can be folded out, the body forming a grip for handling said further tools in their folded out position;

wherein the body comprises an interspace to receive a workpiece for processing and a first and a second member being connected together to pivotably move about a first axis perpendicular to the longitudinal direction of the body between a first position and a second position;

wherein functional elements of the stapler comprise a staple magazine, a staple driver, a staple anvil and an actuating member for actuating the stapler and functional elements of the puncher comprise a punch, a hole die and an actuating member for actuating the punch;

wherein at least. one of the members comprises a common receiving space open to the exterior for accommodating an assembly of the further tools which can be folded out about a second axis;

wherein each of the members comprises at least one functional element of the at least one tool of the group comprising the stapler and the puncher such that the said tool is actuatable by relative movement of the members between the first and second positions.

* * * * *

UNITED STATES PATENT AND TRADEMARK OFFICE

CERTIFICATE OF CORRECTION

PATENT NO. : 6,493,893 B1
DATED : December 17, 2002
INVENTOR(S) : Peter Ackeret

It is certified that error appears in the above-identified patent and that said Letters Patent is hereby corrected as shown below:

Title page,
Item [30], Foreign Application Priority Data, delete "197 02 955" and substitute -- 197 02 955.8 -- in its place; and delete "197 45 799" and substitute -- 197 45 799.1 -- in its place.

Signed and Sealed this

Sixteenth Day of December, 2003

JAMES E. ROGAN
*Director of the United States Patent and Trademark Office*